US008444130B2

(12) United States Patent
Sink et al.

(10) Patent No.: US 8,444,130 B2
(45) Date of Patent: May 21, 2013

(54) DEVICES FOR CAPPING VIALS USEFUL IN SYSTEM AND METHOD FOR DISPENSING PRESCRIPTIONS

(75) Inventors: John Richard Sink, Raleigh, NC (US); Richard D. Mitchelli, Raleigh, NC (US); Charles H. Guthrie, Raleigh, NC (US); Joseph C. Moran, Jr., Durham, NC (US); Demetris P. Young, Durham, NC (US)

(73) Assignee: Parata Systems, LLC, Durham, NC (US)

( * ) Notice: Subject to any disclaimer, the term of this patent is extended or adjusted under 35 U.S.C. 154(b) by 432 days.

(21) Appl. No.: 12/732,462

(22) Filed: Mar. 26, 2010

(65) Prior Publication Data

US 2011/0233840 A1 Sep. 29, 2011

Related U.S. Application Data

(62) Division of application No. 12/241,414, filed on Sep. 30, 2008, now Pat. No. 7,735,301.

(51) Int. Cl.
*B25B 5/04* (2006.01)

(52) U.S. Cl.
USPC ..... 269/86; 269/56; 269/71; 53/317; 53/335; 53/367

(58) Field of Classification Search
USPC ..... 52/55, 56, 71, 86, 289 R; 269/55, 269/56, 71, 86, 289 R; 53/287, 317, 329, 53/33.5, 335, 367; 493/121, 136, 179, 383
See application file for complete search history.

(56) References Cited

U.S. PATENT DOCUMENTS

| | | | |
|---|---|---|---|
| 2,496,877 | A | 2/1950 | Krueger |
| 2,589,693 | A | 3/1952 | Hess |
| 2,665,775 | A | 1/1954 | Smith |
| 2,708,996 | A | 5/1955 | Skillman |

(Continued)

FOREIGN PATENT DOCUMENTS

| | | |
|---|---|---|
| CA | 936 501 | 11/1973 |
| DE | 199 46 374 A1 | 3/2001 |

(Continued)

OTHER PUBLICATIONS

International Search Report and Written Opinion re PCT/US2008/000527 dated Feb. 10, 2009.

*Primary Examiner* — Brian Glessner
*Assistant Examiner* — Adam Barlow
(74) *Attorney, Agent, or Firm* — Myers Bigel Sibley and Sajovec

(57) ABSTRACT

A method for securing a closure on a cylindrical container (such as a pharmaceutical vial) includes: positioning a closure in a first position, the closure being substantially centered via a centering assembly along an axis that is generally normal to the closure; translating the substantially centered closure along the axis to a second position; positioning a cylindrical container, the container being substantially centered via the centering assembly along the axis; translating the substantially centered closure along the axis to a third position in which it is adjacent the substantially centered container; and relatively rotating the closure and the container to secure the closure to the container. With such a method, both the closure and the cylinder can be centered along the axis, thereby registering them with each other for reliable securing.

10 Claims, 24 Drawing Sheets

U.S. PATENT DOCUMENTS

| | | | | | |
|---|---|---|---|---|---|
| 2,865,532 | A | | 12/1958 | Smith | |
| 3,023,851 | A | | 3/1962 | Stiller | |
| 3,144,958 | A | | 8/1964 | Gumpertz | |
| 3,160,793 | A | | 12/1964 | Colburn | |
| 3,179,288 | A | * | 4/1965 | Davy | 221/15 |
| 3,185,851 | A | | 5/1965 | D'Emilio | |
| 3,196,276 | A | | 7/1965 | Naab | |
| 3,206,062 | A | | 9/1965 | Rappaport | |
| 3,310,199 | A | | 3/1967 | Roberts | |
| 3,312,372 | A | | 4/1967 | Cooper, Jr. | |
| 3,410,450 | A | | 11/1968 | Fortenberry | |
| 3,417,542 | A | | 12/1968 | Merrill | |
| 3,436,736 | A | | 4/1969 | Platt | |
| 3,556,342 | A | | 1/1971 | Guarr | |
| 3,599,152 | A | | 8/1971 | Williams | |
| 3,653,176 | A | | 4/1972 | Gess | |
| 3,674,040 | A | | 7/1972 | Howells et al. | |
| 3,730,388 | A | | 5/1973 | Bender | |
| 3,732,544 | A | | 5/1973 | Obland | |
| 3,780,907 | A | | 12/1973 | Colburn | |
| 3,815,780 | A | | 6/1974 | Bauer | |
| 3,837,139 | A | * | 9/1974 | Roseberg | 53/501 |
| 3,852,941 | A | * | 12/1974 | Bross | 53/317 |
| 3,885,702 | A | | 5/1975 | Joslin | |
| 3,917,045 | A | | 11/1975 | Williams | |
| 4,045,276 | A | | 8/1977 | Zodrow | |
| 4,222,214 | A | | 9/1980 | Schultz et al. | |
| 4,267,942 | A | | 5/1981 | Wick | |
| 4,434,602 | A | | 3/1984 | Culpepper | |
| 4,546,901 | A | | 10/1985 | Buttarazzi | |
| 4,573,606 | A | | 3/1986 | Lewis | |
| 4,655,026 | A | | 4/1987 | Wigoda | |
| 4,662,153 | A | | 5/1987 | Wozniak | |
| 4,664,289 | A | | 5/1987 | Shimizu | |
| 4,674,259 | A | | 6/1987 | Hills | |
| 4,674,651 | A | | 6/1987 | Scidmore | |
| 4,693,057 | A | | 9/1987 | Rittinger | |
| 4,695,954 | A | | 9/1987 | Rose | |
| 4,696,144 | A | | 9/1987 | Bankuty et al. | |
| 4,762,029 | A | | 8/1988 | Chen | |
| 4,766,542 | A | | 8/1988 | Pilarczyk | |
| 4,767,023 | A | | 8/1988 | Hackmann | |
| 4,805,377 | A | | 2/1989 | Carter | |
| 4,869,392 | A | | 9/1989 | Moulding, Jr. | |
| 4,918,604 | A | | 4/1990 | Baum | |
| 4,919,014 | A | | 4/1990 | Chen et al. | |
| 4,949,014 | A | | 8/1990 | Gasvoda | |
| 4,971,513 | A | | 11/1990 | Bergerioux | |
| 4,979,350 | A | | 12/1990 | Arnemann | |
| 4,980,292 | A | | 12/1990 | Elbert | |
| 4,984,709 | A | | 1/1991 | Weinstein | |
| 5,016,422 | A | | 5/1991 | Popp et al. | |
| 5,018,644 | A | | 5/1991 | Hackmann | |
| 5,047,948 | A | | 9/1991 | Turner | |
| 5,224,716 | A | * | 7/1993 | Saeda et al. | 279/5 |
| 5,437,140 | A | | 8/1995 | Molinaro | |
| 5,437,361 | A | | 8/1995 | Ohmori et al. | |
| 5,438,814 | A | | 8/1995 | Lovett et al. | |
| 5,617,765 | A | | 4/1997 | Bennett | |
| 5,647,251 | A | | 7/1997 | Hardman | |
| 5,819,508 | A | * | 10/1998 | Kraft et al. | 53/492 |
| RE37,829 | E | | 9/2002 | Charhut | |
| 6,519,913 | B2 | | 2/2003 | Higashizaki et al. | |
| 7,082,739 | B2 | * | 8/2006 | Guernieri et al. | 53/367 |
| 7,565,785 | B2 | * | 7/2009 | Sink et al. | 53/331.5 |
| 2008/0141631 | A1 | | 6/2008 | Brown | |
| 2009/0151480 | A1 | * | 6/2009 | Sakurai et al. | 73/865.8 |

FOREIGN PATENT DOCUMENTS

| | | |
|---|---|---|
| GB | 1 168 758 | 10/1969 |
| GB | 1 411 951 | 10/1975 |
| JP | 61-104904 | 5/1986 |
| JP | 63-208410 | 8/1988 |
| JP | 1-288265 | 11/1989 |
| JP | 2-028417 | 1/1990 |

* cited by examiner

DEVICES FOR CAPPING VIALS USEFUL IN SYSTEM AND METHOD FOR DISPENSING PRESCRIPTIONS

RELATED APPLICATION

This application is a divisional of and claims priority from U. S. application Ser. No. 12/241,414,filed Sep. 30, 2008, which is a divisional of and claims priority from U.S. application Ser. No. 11/679,850, filed Feb. 28, 2007,which is a non-provisional of and claims priority from U.S. Provisional Patent Application No. 60/885,269,filed Jan. 17, 2007,the disclosure of each of which is hereby incorporated herein in its entirety.

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Drawbacks to these systems typically include the relatively low speed at which prescriptions are filled and the absence in these systems of securing a closure (i.e., a lid) on the container after it is filled.

One additional automated system for dispensing pharmaceuticals is described in some detail in U.S. Pat. No. 6,971,541 to Williams et al. This system has the capacity to select an appropriate vial, label the vial, fill the vial with a desired quantity of a selected pharmaceutical tablet, apply a cap to the filled vial, and convey the labeled, filled, capped vial to an offloading station for retrieval.

Although this particular system can provide automated pharmaceutical dispensing, certain of the operations may be improved. For example, the reliability of the capping operation may be improved and desirable. Also, the ability to accommodate multiple styles and sizes of vials and caps with a single mechanism may also be desirable.

SUMMARY OF THE INVENTION

As a first aspect, embodiments of the present invention are directed to a method for securing a closure on a cylindrical container (such as a pharmaceutical vial). The method comprises: positioning a closure in a first position, the closure being substantially centered via a centering assembly along an axis that is generally normal to the closure; translating the substantially centered closure along the axis to a second position; positioning a cylindrical container, the container being substantially centered via the centering assembly along the axis; translating the substantially centered closure along the axis to a third position in which it is adjacent the substantially centered container; and relatively rotating the closure and the container to secure the closure to the container. With such a method, both the closure and the cylinder can be centered along the axis, thereby registering them with each other for reliable securing.

In some embodiments, the method includes positioning the closure and the container on a positioning stage. Also, in some embodiments the closure and the container are substantially centered via centering members of the centering assembly.

As a second aspect, embodiments of the present invention are directed to an apparatus for securing a closure on a cylindrical container. The apparatus comprises a centering assembly having a main stage and an elevator. The main stage includes a receiving region for separately receiving a closure and a container and further comprises centering members that are configured to substantially center the closure and the container sequentially along a first axis generally normal to the stage. The elevator is positioned such that a lifting member thereof is disposed over the main stage. The elevator includes a capture member that is configured to capture a closure and is configured to move between a lowered position, in which the capture member can capture the closure from the main stage, a raised position, in which a container can be received on the main stage below the captured closure, and an intermediate securing position, in which the closure is lowered to contact an upper edge of the container. The main stage and the capture member are configured to rotate relative to each other about the first axis, such that a closure captured with the capturing member can be rotatably secured to a container positioned on the main stage when the elevator is in the securing position.

As another aspect, embodiments of the present invention are directed to an apparatus for centering an object, comprising: a main stage; a plurality of centering members pivotally interconnected with the main stage, each of the centering members being rotatable about a respective axis of rotation, the axes of rotation being substantially parallel with each other, wherein rotation of the centering members about their respective axes of rotation causes the centering members to contact an object positioned on the main stage, and wherein contact with each of the centering members indicates that the object is centered on the stage; and a shield overlying at least one of the centering members, the shield being pivotable about the axis of rotation of the underlying centering member relative to the main stage and relative to the centering member, the shield having a contact edge that overhangs an edge of the centering member. The shield is configured to rotate with the centering member when no force above a predetermined level is applied to the contact edge of the shield, and wherein the shield is configured to rotate relative to the centering member when a force above a predetermined level is applied to the contact edge of the shield.

As a further aspect, embodiments of the present invention are directed to an apparatus for centering and gripping an object, comprising: a main stage rotatable via a drive unit about a first axis of rotation; a plurality of centering members pivotally interconnected with the main stage, each of the centering members being rotatable about a respective axis of rotation, the axes of rotation being substantially parallel with each other, wherein rotation of the centering members about their respective axes of rotation causes the centering members to contact an object positioned on the main stage such that contact with each of the centering members centers the object on the stage. The centering assembly includes a central sun gear that rotates with the main stage about the first axis, and wherein each of the clamps is connected to and rotatable with a respective clamp gear, each of the clamp gears engaging and being driven by the sun gear. The sun gear is coupled to a drive unit via a clutch. The clutch is configured such that, when the centering members are free to rotate relative to the main stage, the clutch engages the sun gear, such that sun gear remains stationary and the clamp gears rotate relative to the main stage, and wherein when the centering members are prevented from rotating, the sun gear rotates with the main stage.

As an additional aspect, embodiments of the present invention are directed to a method for securing a closure on a cylindrical container, comprising: positioning a closure in a first position, the closure being substantially centered via a centering assembly along an axis that is generally normal to the closure; translating the substantially centered closure along the axis to a second position; positioning a cylindrical container, the container being substantially centered via the centering assembly along the axis; translating the substantially centered closure along the axis to a third position in which it is adjacent the substantially centered container; and relatively rotating the closure and the container to secure the closure to the container, wherein rotating the container comprises gripping the container with a plurality of centering members, each of the centering members being rotatable about a respective axis of rotation. The closure and centering members are configured such that, when each of the centering members is in contact with the container, an angle defined between each of the respective axes of rotation, a contact point between the contact member and the container, and the axis normal to the closure is between about 140 and 178 degrees.

DETAILED DESCRIPTION OF EMBODIMENTS OF THE INVENTION

Figure 1:
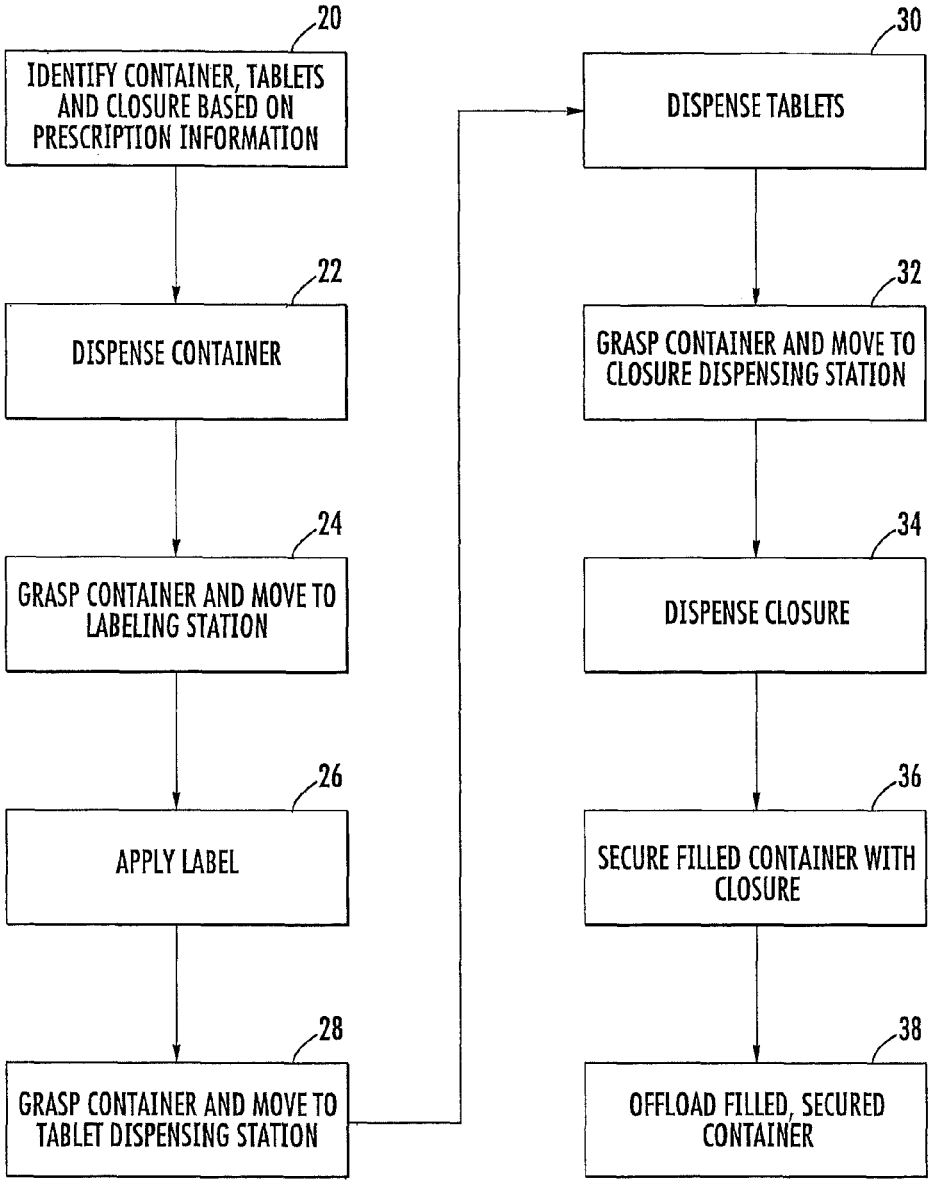
FIG. 1 is a flow chart illustrating an embodiment of a method according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As described above, the invention relates generally to a system and process for dispensing pharmaceuticals. An exemplary process is described generally with reference to FIG. 1. The process begins with the identification of the proper container, tablets or capsules and closure to be dispensed based on a patient's prescription information (Box 20). A container of the proper size is dispensed at a container dispensing station (Box 22), then grasped and moved to a labeling station (Box 24). The labeling station applies a label (Box 26), after which the container is transferred to a tablet dispensing station (Box 28), from which the designated tablets are dispensed in the designated amount into the container (Box 30). The filled container is then moved to a closure dispensing station (Box 32), where a closure of the proper size has been dispensed (Box 34). The filled container is secured with a closure (Box 36), then transported to an offload station and offloaded (Box 38).

Figure 2:
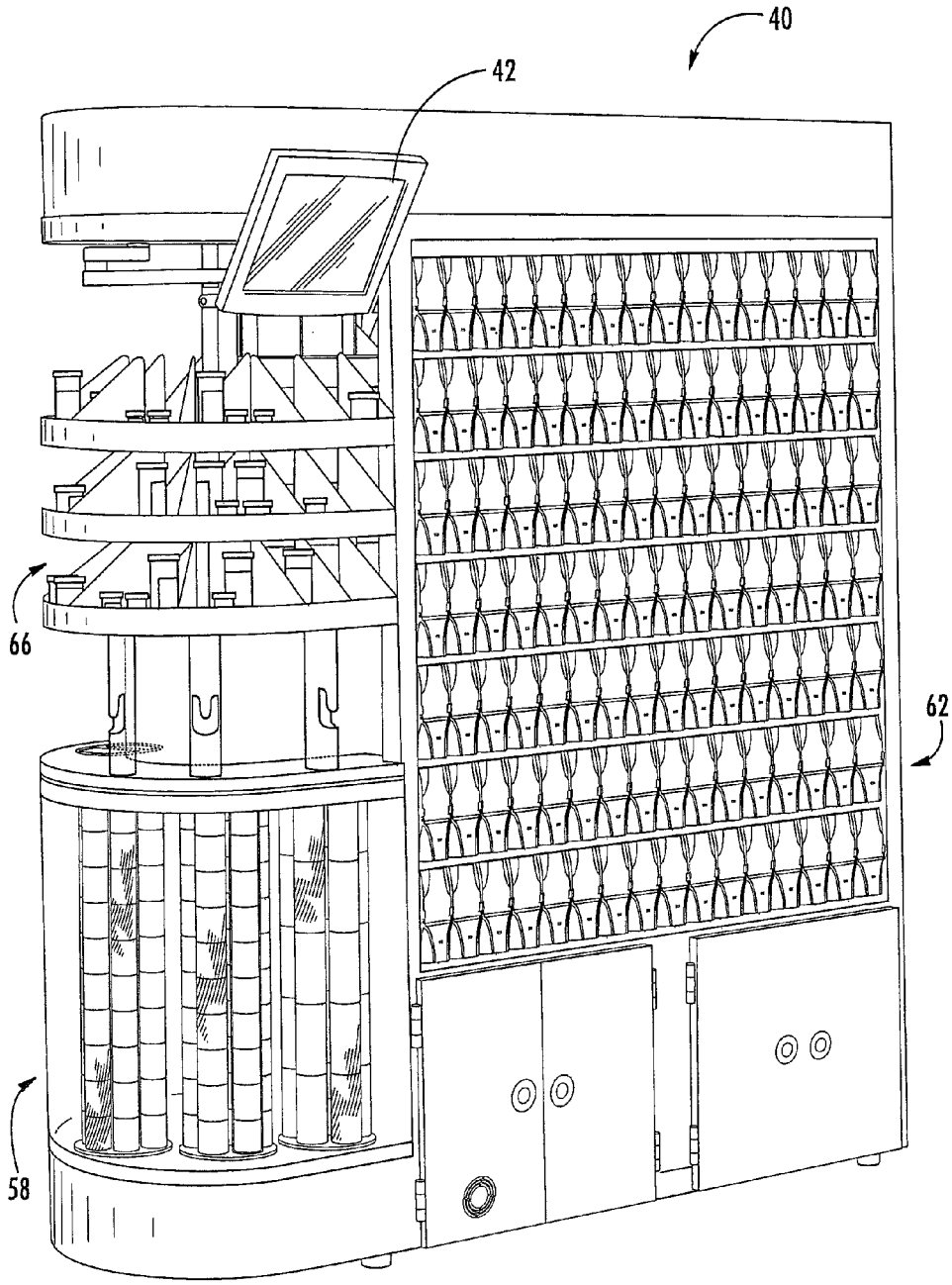
FIG. 2 is a perspective view of a pharmaceutical tablet dispensing system according to the present invention.
Figure 3:
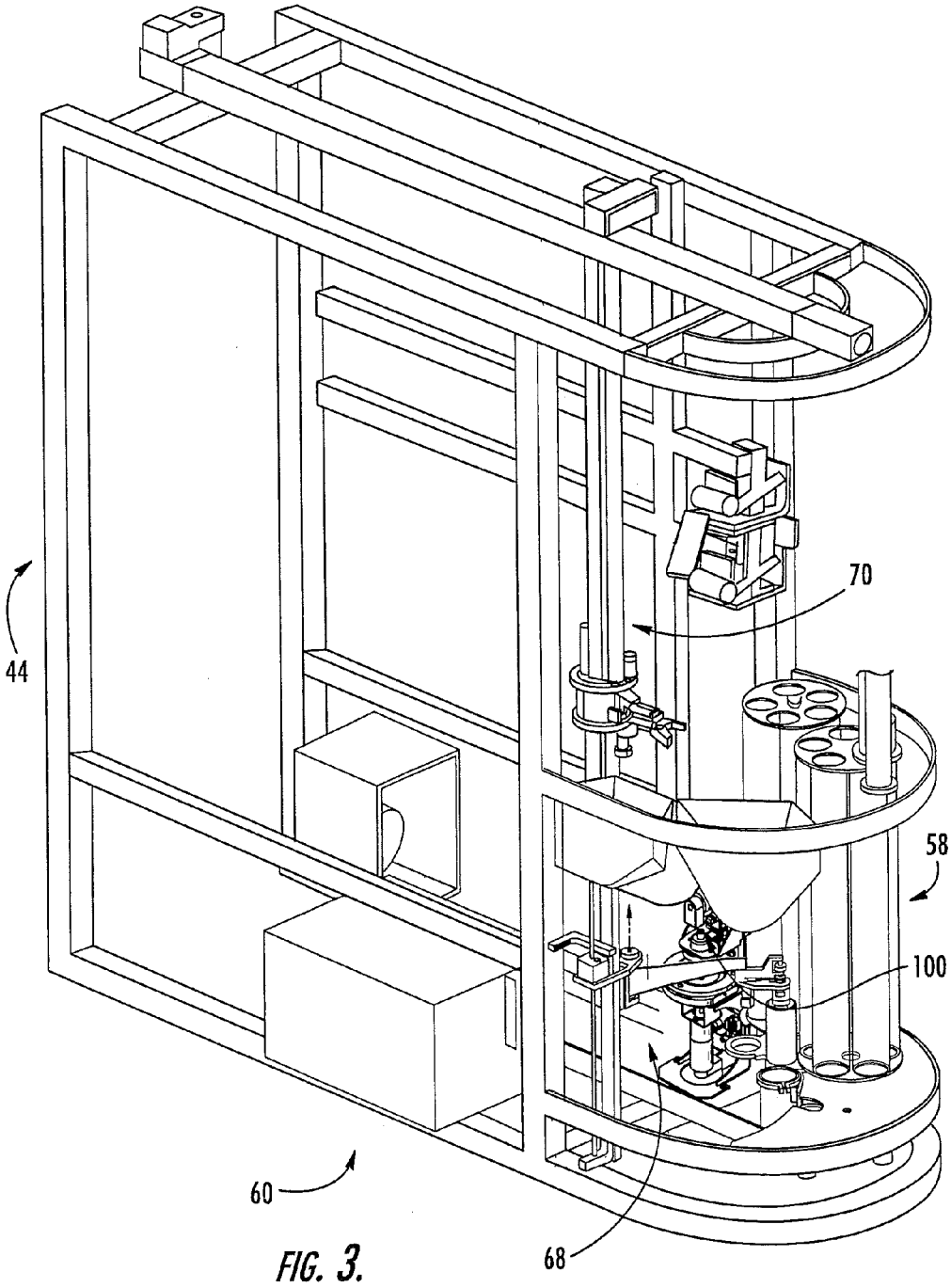
FIG. 3 is a cutaway view of the system of FIG. 2 illustrating the support frame, the container dispensing station, the labeling carrier, the dispensing carrier, and the closure dispensing station.

A system that can carry out this process is illustrated in FIGS. 2 and 3 and designated broadly therein at 40. The system 40 includes a support frame 44 for the mounting of its various components. The system 40 generally includes as operative stations a controller (represented herein by a graphics user interface monitor 42), a container dispensing station 58, a labeling station 60, a tablet dispensing station 62, a closure station 100, and an offloading station 66. In the illustrated embodiment, containers, tablets and closures are moved between these stations with two different conveying devices: a labeling carrier 68 and a dispensing carrier 70; however, in some embodiments only a single carrier may be employed, or one or more additional carriers may be employed. With the exception of the closure station 100, which is described in detail below, each of the other operative stations and the conveying devices is described in detail in U.S. Pat. No. 6,971,541 to Williams et al., the disclosure of which is hereby incorporated herein in its entirety.

Figure 4:
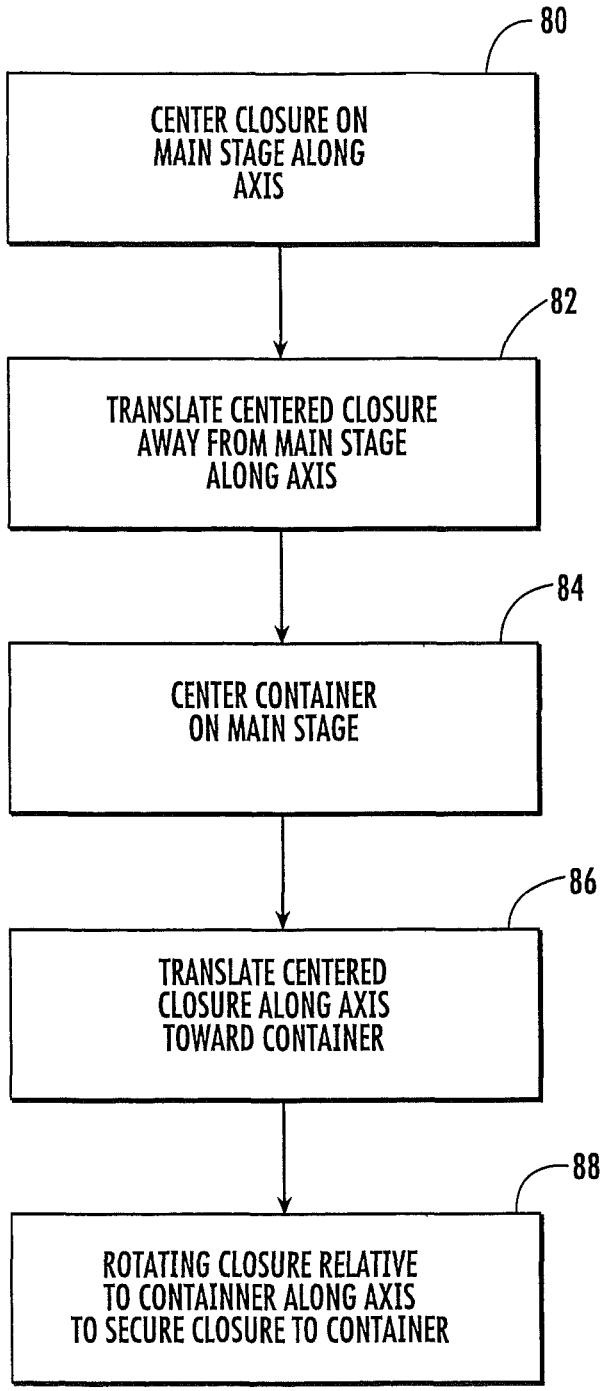
FIG. 4 is a flow chart illustrating an embodiment of a method of applying a closure to a filled vial according to embodiments of the present invention.

Referring now to FIG. 4, general operations of the closure station 100 are illustrated in the form of a flow chart. The closure station 100 can address situations that can arise with prior art systems in which a filled pharmaceutical vial may not be properly aligned with a cap or closure in order for the closure to be applied. According to embodiments of the present invention, a closure is centered along an axis at a first position (Block 80), then translated along that axis to a second position (Block 82). A filled vial or other container is then centered along the axis (Block 84). The centered closure is translated along the axis to a third position adjacent the container (Block 86), and the container is rotated relative to the closure about the axis to secure the closure to the container (Block 88). This method can assure that the closure and container are both centered about the same axis, which in turn can improve the reliability of the process of securing the closure onto the container.

Figure 5:
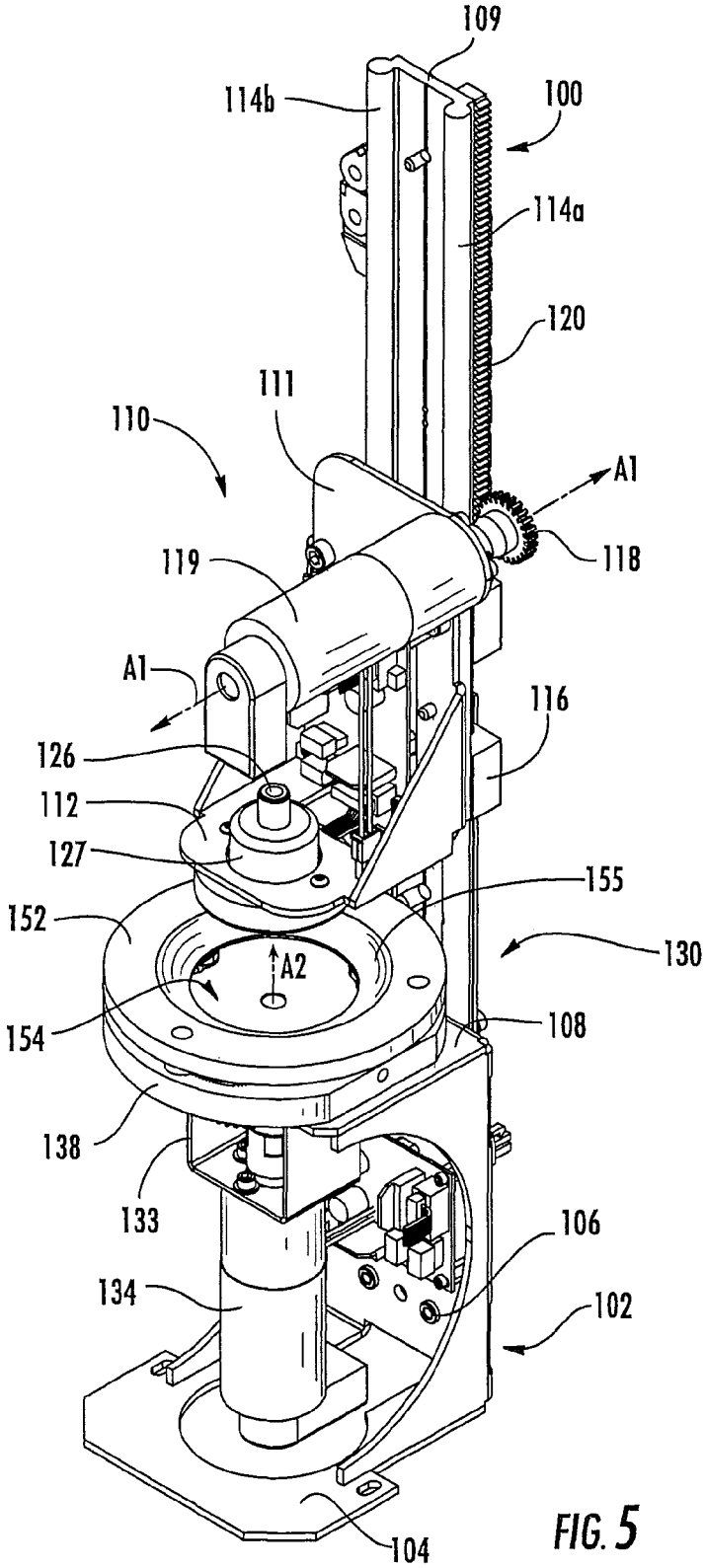
FIG. 5 is a perspective view of a closure station according to embodiments of the present invention in a lowered position.

Referring now to FIG. 5, the structure of the closure station 100 (which is capable of carrying out the method described in FIG. 4) is illustrated in some detail therein. The closure station 100 includes a frame 102 upon which other components are mounted. The frame 102 comprises a lower platform 104 that is mounted to the support frame 44 of the system 40 (see FIG. 3 for mounting orientation). An upright support 106 extends upwardly from one end of the lower platform 104. An upper platform 108 extends in cantilever fashion from the upper end of the support 106 over the lower platform 104. An elevator mounting member 109 is fixed to the support 106 and extends upwardly therefrom.

As used herein to describe the relative positions of various components, the terms "front," "forward", and derivatives thereof refer to the direction in which the upper and lower platforms 108, 104 extend away from the support 106. The terms "rear", "back" and derivatives thereof refer to the direction opposite the forward direction. The terms "outward," "outer," "lateral" and derivatives thereof refer to the direction beginning at a vertical plane parallel to the forward direction that divides the frame 102 in the center and extending toward its periphery; the terms "inner," "inward" and derivatives thereof refer to the direction opposite the outer direction.

Figure 6:
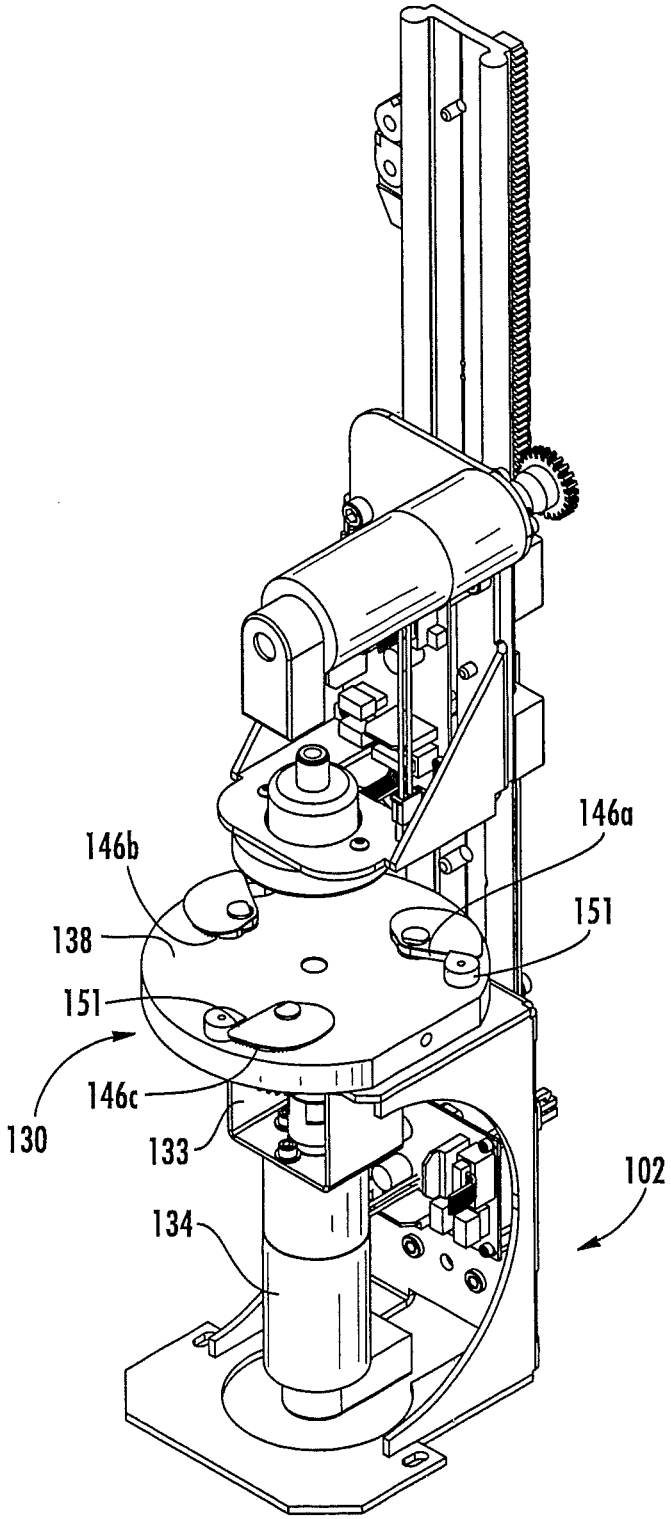
FIG. 6 is a perspective view of the closure station of FIG. 5 in a lowered position with the upper stage removed.
Figure 7:
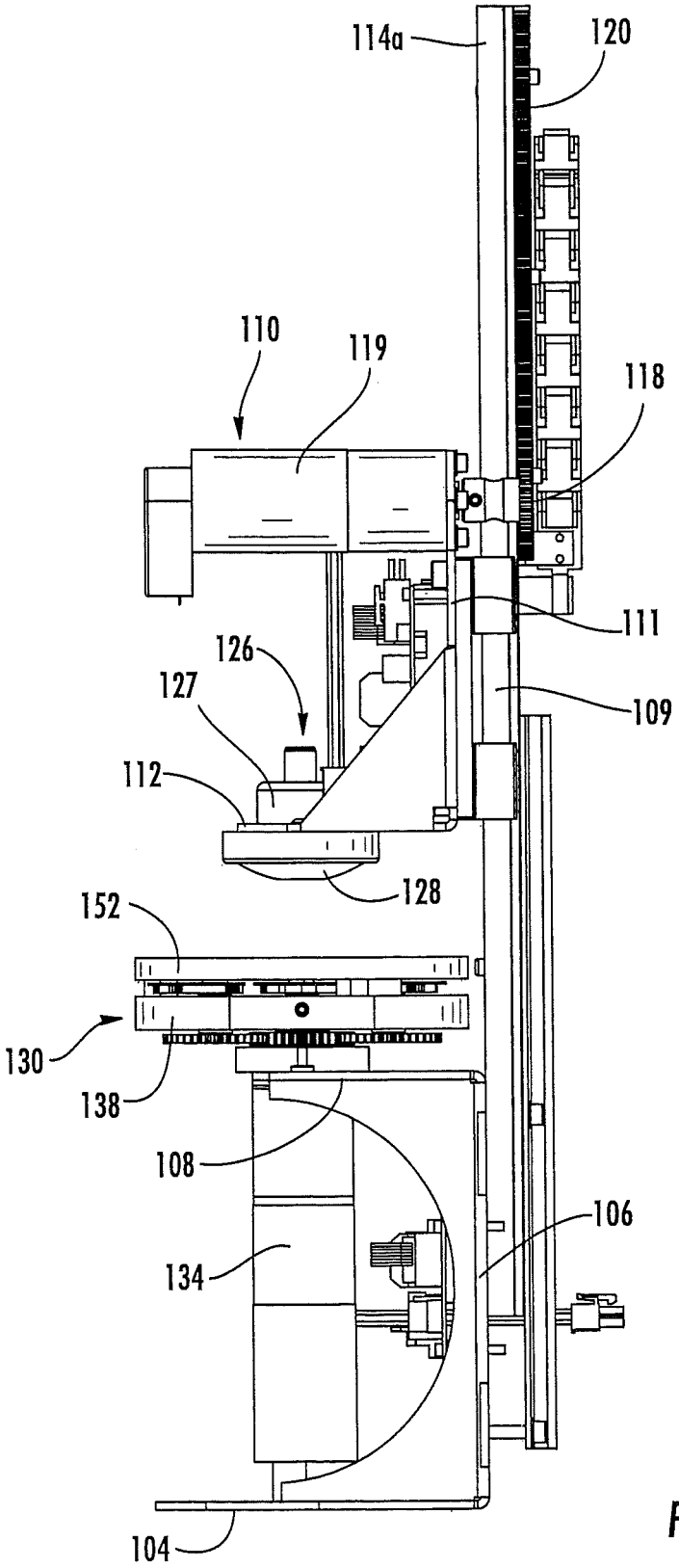
FIG. 7 is a side view of the closure station of FIG. 5 in a lowered position.
Figure 8:
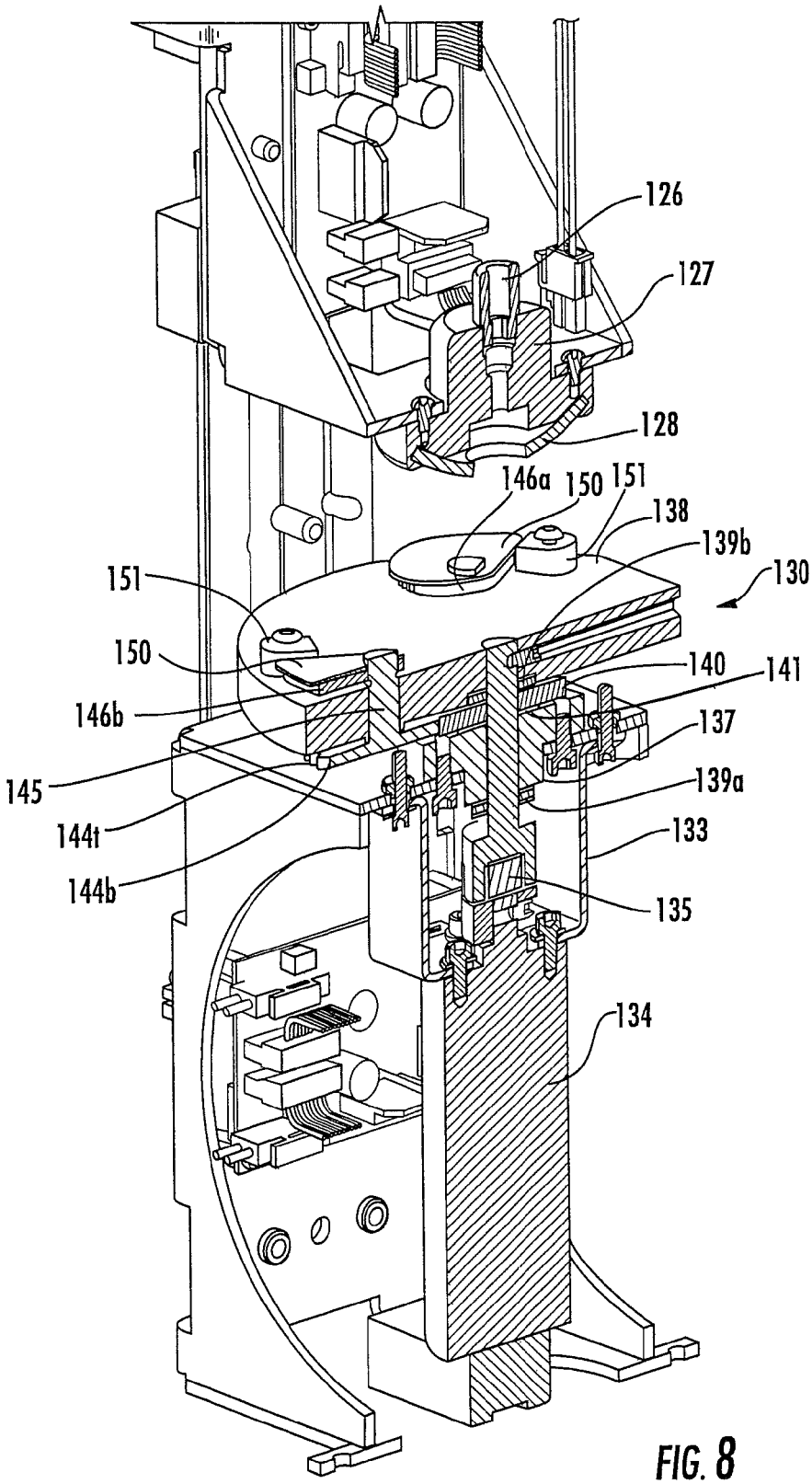
FIG. 8 is an enlarged perspective section view of the closure station of FIG. 6.
Figure 9A:
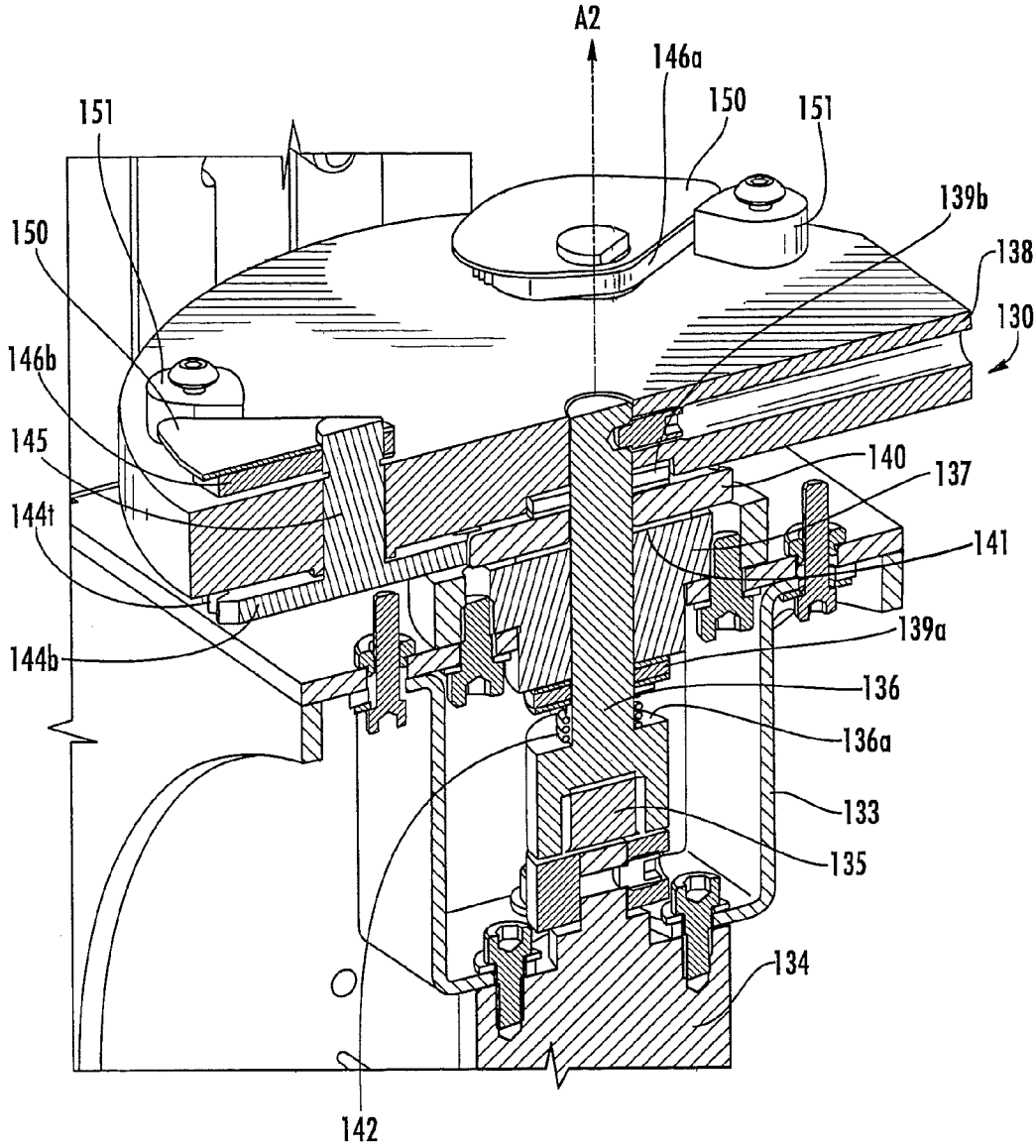
FIG. 9*a* is an enlarged top perspective section view of the main stage and drive assembly of the closure station of FIG. 6.
Figure 9B:
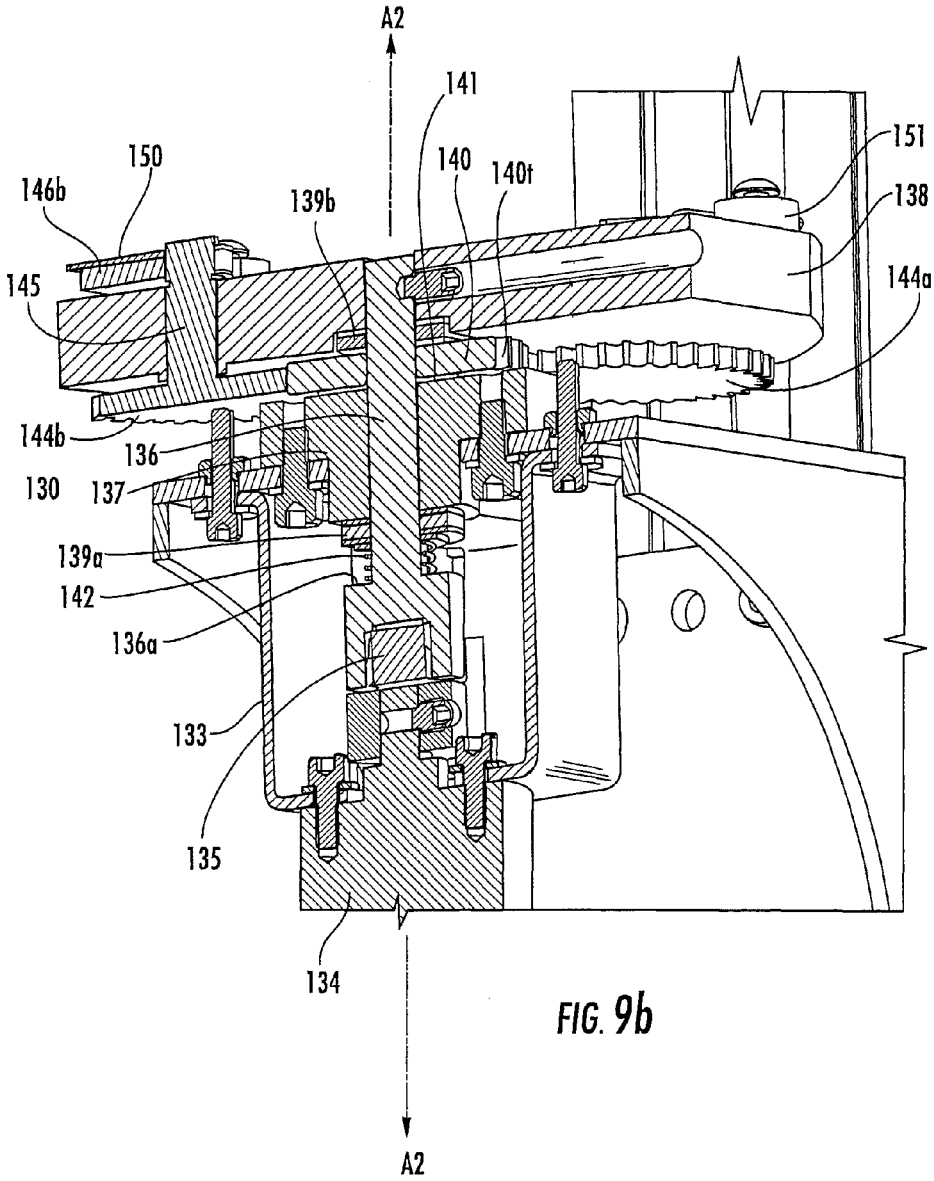
FIG. 9*b* is an enlarged bottom perspective section view of the main stage and drive assembly of the closure station of FIG. 6.
Figure 9C:
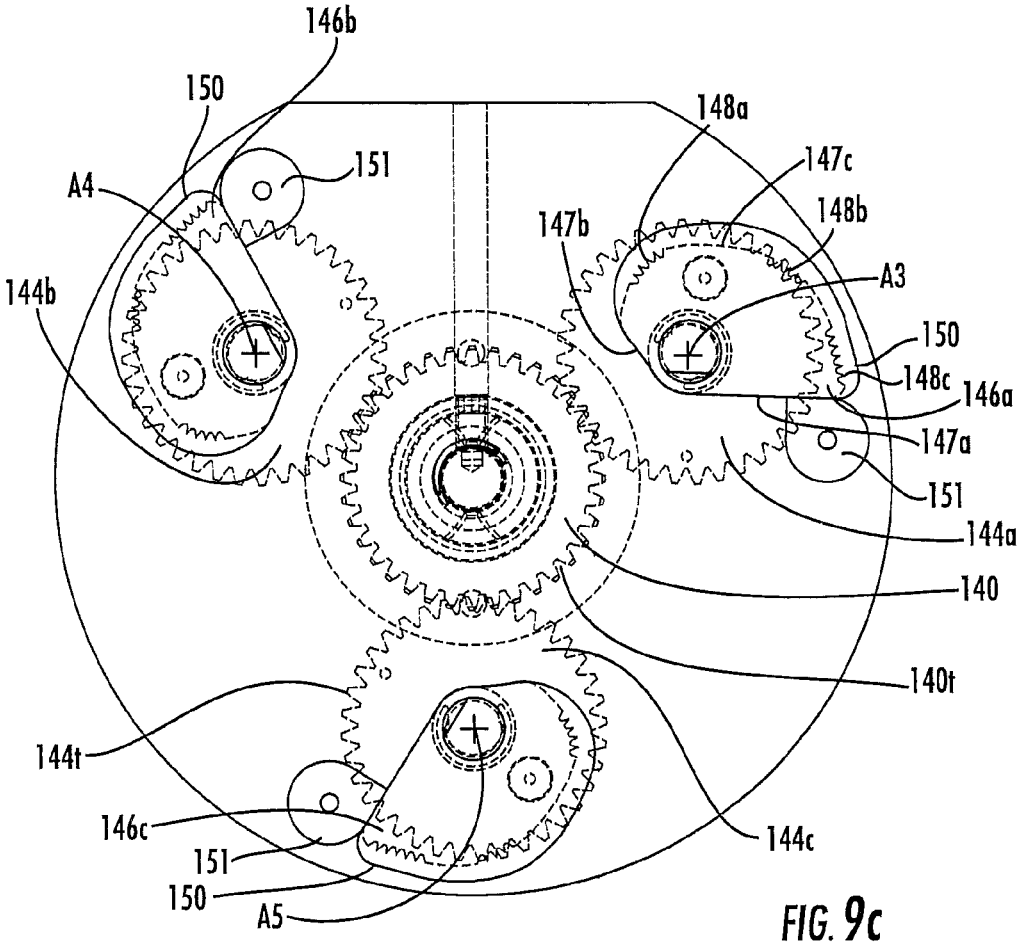
FIG. 9*c* is a top view of the main stage of the closure station of FIG. 6 with the upper stage removed.

Referring again to FIG. 5 and more particularly to FIGS. 6 and 7, an elevator 110 is mounted to the rear surface of the support 106. The elevator 110 has a base member 111 that extends vertically and generally parallel to the elevator mounting member 109. A floor 112 merges with the lower end of the base member 111 and extends forwardly over the upper platform 108 of the frame 102. Rails 114*a*, 114*b* are formed in the outer edges of the elevator mounting member 109 and extend for virtually its entire height. The rails 114*a*, 114*b* engage bearings 116 that are mounted to the rear surface of the base member 111. A drive pinion 118 is rotatably mounted on the rear side of the base member 111. A drive motor 119 (FIG. 7) is mounted on the front side of the base member 111 opposite the drive pinion 118 to rotate the drive pinion 118 about the axis A1. A toothed rack 120 with outwardly-facing teeth extends vertically on the back side of the elevator mounting member 109.

Referring to FIGS. 5 and 7, a suction block 127 is mounted to the floor 112. The block 127 includes an air intake bore 126 that leads from the upper surface of the block 127 to its lower surface, where a suction pad 128 is mounted. An air hose (not shown) is inserted into the bore 126 and is attached to a suction source (also not shown) to apply suction to the suction pad 128.

Referring now to FIGS. 5, 6, 8, 9*a* and 9*b*, a centering assembly 130 is mounted to the upper platform 108 and support 106 of the frame 102. A mounting bracket 133 is mounted to the underside of the upper platform 108. A motor 134 is mounted to the underside of the mounting bracket 133. A shaft 136 having a shoulder 136*a* is coupled to the motor 134 via a coupling 135 and extends upwardly therefrom through a bore in a bearing 137 that is fixed to the upper platform 108. The shaft 136 also extends through a spring 142 that is positioned above and rests on the shoulder 136*a*, a thrust bearing 139*a* against which the upper end of the spring 142 presses, a sun gear 140 with teeth 140*t* that is separated from the top surface of the bearing 137 via a clutch washer 141, and a second thrust bearing 139*b*. The shaft 136 terminates at a fixed joint with a main stage 138 that is positioned above the thrust bearing 139*b*. The shaft 136, the sun gear 140, and the main stage 138 are all rotatable about an axis of rotation A2.

Referring once again to FIGS. 6, 8, 9*a*-9*c* and 12*a*, three clamp gears 144*a*, 144*b*, 144*c* are mounted via rotating shafts 145 to the underside of the main stage 138 for rotation about respective axes of rotation A3, A4, A5. The clamp gears 144*a*, 144*b*, 144*c* are mounted near the periphery of the main stage 138 at 120 degree intervals about the axis A2, such that their teeth 144*t* engage the teeth 140*a* of the sun gear 140. A respective clamp 146*a*, 146*b*, 146*c* is mounted on each shaft 145 above the upper surface of the main stage 138.

Referring now to FIGS. 9*a*-9*c* and 12*a*-12*c*, each clamp 146*a*, 146*b*, 146*c* is generally teardrop-shaped, with a long straight edge 147*a*, a shorter curved edge 147*b* that meets the edge 147*a* near the axis of rotation of the clamp, and an arcuate edge 147*c*. Three sets of teeth 148*a*, 148*b*, 148*c* are located about the arcuate edge 147*c* of each clamp. A thin shield 150 of similar but slightly larger shape overlies each clamp 146*a*, 146*b*, 146*c*. The shields 150 are attached magnetically to the clamps and also rotate about their respective axes of rotation with the clamps, but are also free to rotate independently of the clamps if an independent horizontal force is applied thereto. The magnetic interaction between the shields and the clamps can be created by, for example, employing a sheet metal shield and a magnet in each clamp, a plastic shield with a molded-in magnet and a metal clamp, or other variations. A stop 151 is positioned adjacent each of the clamps 146*a*, 146*b*, 146*c*.

Referring again to FIG. 5, an upper stage 152 is fixed to the upper surface of the main stage 138 above the clamps 146*a*, 146*b*, 146*c*. The upper stage 152 includes a large central aperture 154 that is bounded by sloping surfaces 155 that drain into the aperture 154.

Figure 10:
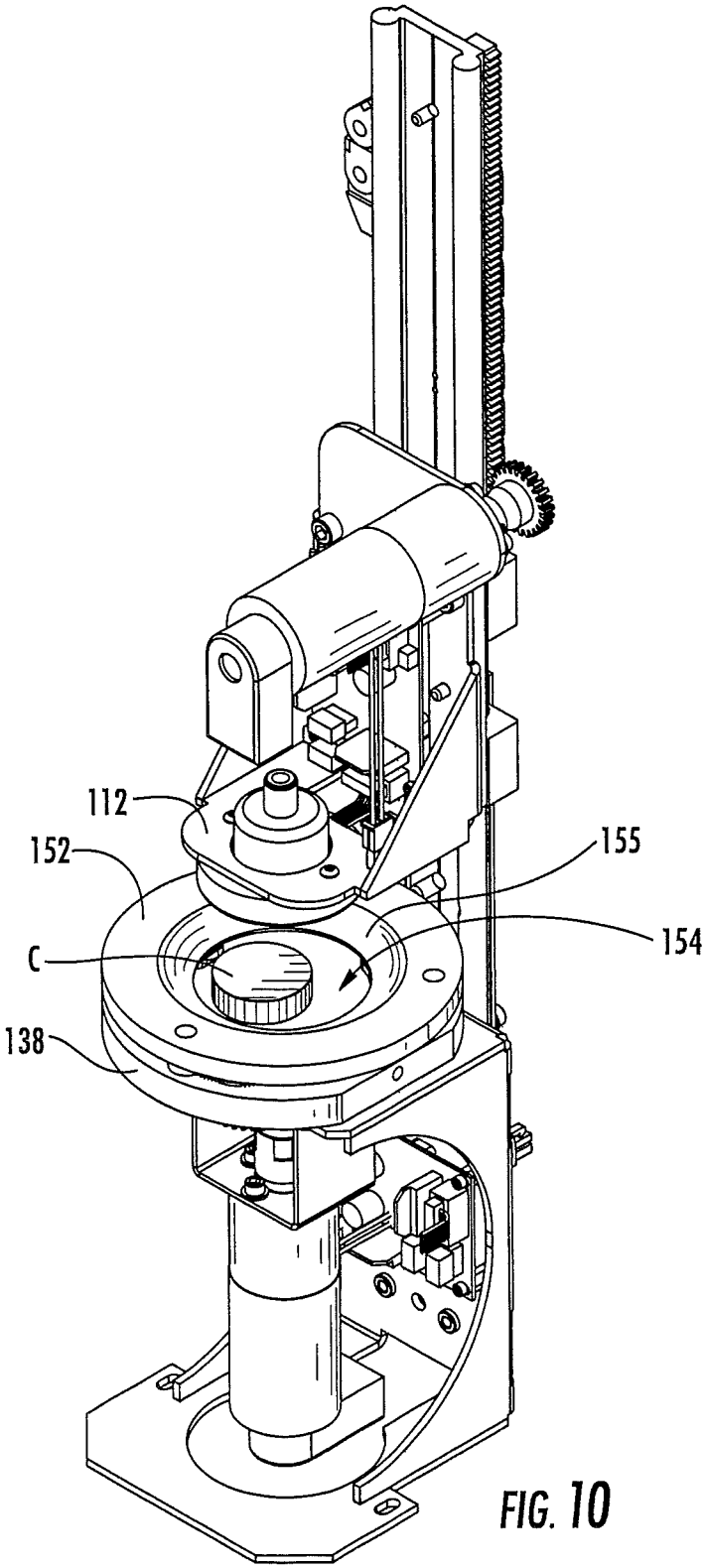
FIG. 10 is a perspective view of the closure station of FIG. 5 showing the reception of a closure, with the elevator in an intermediate position.

Operation of the closure station 100 can be understood with reference to FIGS. 10-21. As shown in FIG. 10, the closure station 100 can begin in an intermediate position, in which the suction pad 128 located beneath the suction block 127 of the elevator 110 is located just above the upper stage 152. In this position, the closure station 100 is free to receive a closure (i.e., a lid for a vial) from, for example, a closure dispensing station similar to that shown in U.S. Pat. No. 6,971,541 to Williams et al., or one similar to that shown in co-pending and co-assigned U.S. patent application Ser. No. 11/693,929, filed Mar. 30, 2007. In some embodiments, the closure is automatically dispensed and travels down a chute (not shown) to the closure station 100. The gap between the suction pad 128 and the upper stage 152 is such that a closure can enter the upper stage 152, but cannot escape.

The controller 42 signals the closure station 100 that a vial is to be filled, which causes a closure C to be dispensed from the closure dispenser. Because receipt of the closure C is facilitated with the clamps 146*a*, 146*b*, 146*c* retracted as far as possible, the controller 42 signals the drive motor 134 to rotate the drive motor shaft 136 (in a clockwise direction from the vantage point of FIG. 12*c*). Rotation of the drive motor shaft 135 rotates the main stage 138 (also in a clockwise direction from the vantage point of FIG. 12*c*) about the axis A2. However, compression in the spring 142 draws the main stage 138 against the thrust bearing 139*b*, which in turn forces the thrust bearing 139*b* into the sun gear 140 and the sun gear 140 against the clutch washer 141. Friction between the sun gear 140 and the clutch washer 141 prevents the sun gear 140 from rotating about the axis A2. As a result, as the main stage 138 rotates, the engagement of each of the clamp gears 144*a*, 144*b*, 144*c* with the sun gear 140 rotates the clamp gears 144*a*, 144*b*, 144*c* in a clockwise direction (from the vantage point of FIGS. 9*c* and 12*a*-12*c*) about, respectively, the axes A3, A4, A5, which in turn rotates the clamps 146*a*, 146*b*, 146*c* clockwise about the same axes. As the clamps 146*a*, 146*b*, 146*c* rotate, their arcuate edges 147*c* rotate to face generally outwardly from the axis A2. This disposition opens the main stage 138 to receive a closure C from the closure dispenser. Clamp rotation ceases when each clamp 146*a*, 146*b*, 146*c* strikes its respective stop 151. Continued rotation of the main stage 138 causes the sun gear 140 to slip and rotate with respect to the clutch washer 141. Regardless of additional rotation of the main stage 138, relative rotation of the main stage 138, the sun gear 140 and the clamps 146*a*, 146*b*, 146*c* ceases (see FIGS. 12*a*-12*c*).

As shown in FIG. 10, upon arriving at the closure station 100, the closure C is received in the aperture 154 of the upper stage 152. The sloping surfaces 155 assist in decelerating the closure C as it exits the chute and urge the closure C to come to rest in the aperture 154.

Once the closure C has been deposited in the aperture 154 (the presence of the closure C can be determined in different ways, such as detection by a sensor located in a closure delivery chute, the passage of a predetermined period of time, or the like), the controller 42 reverses the direction of the drive motor 134. Thus, the motor 134 rotates the main stage 138 counterclockwise (from the vantage point of FIG. 12*c*) about the axis A2. Again, the compression in the spring 142 generates sufficient force on the shaft 136 that the clutch washer 141 prevents rotation of the sun gear 140. Consequently, rotation of the main stage 138 rotates the clamp gears 144*a*, 144*b*, 144*c* and the clamps 146*a*, 146*b*, 146*c* counterclockwise (from the vantage point of FIGS. 12*c*, 13*a* and 13*b*) and out from under the upper stage 152. Thus, the arcuate edges 147*c* of the clamps 146*a*, 146*b*, 146*c*, which begin facing radially outwardly from the center of the main stage 138, rotate to face inwardly toward axis A2 (see FIGS. 13*a* and 13*b*).

As the clamps 146*a*, 146*b*, 146*c* continue to rotate counterclockwise, each of the shields 150 resting atop each clamp 146*a*, 146*b*, 146*c* rotates also. Because the shields 150 overhang the arcuate edges 147*c* of the clamps 146*a*, 146*b*, 146*c*, the edge of the shield 150 strikes the closure C first. Contact with the shield 150 urges the closure C toward the center of the aperture 154. The presence of the shields 150 can prevent the closure C, which may have ridges to facilitate gripping by someone subsequently attempting to unscrew the closure C or other childproofing features, from becoming snagged or caught on one of the sets of teeth 148*a*, 148*b*, 148*c* of the arcuate edge 147*c* as it is being urged to the center of the aperture 154.

Figure 14A:
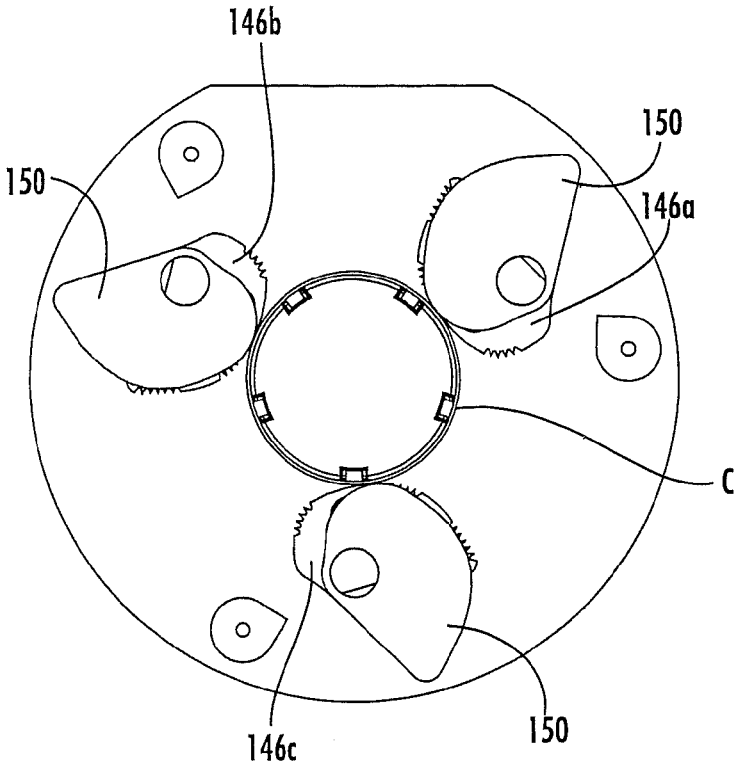
FIG. 14*a* is a top view of the main stage of the closure station of FIG. 6 with the upper stage and shields removed showing the clamps and shields closed on a closure.
Figure 14B:
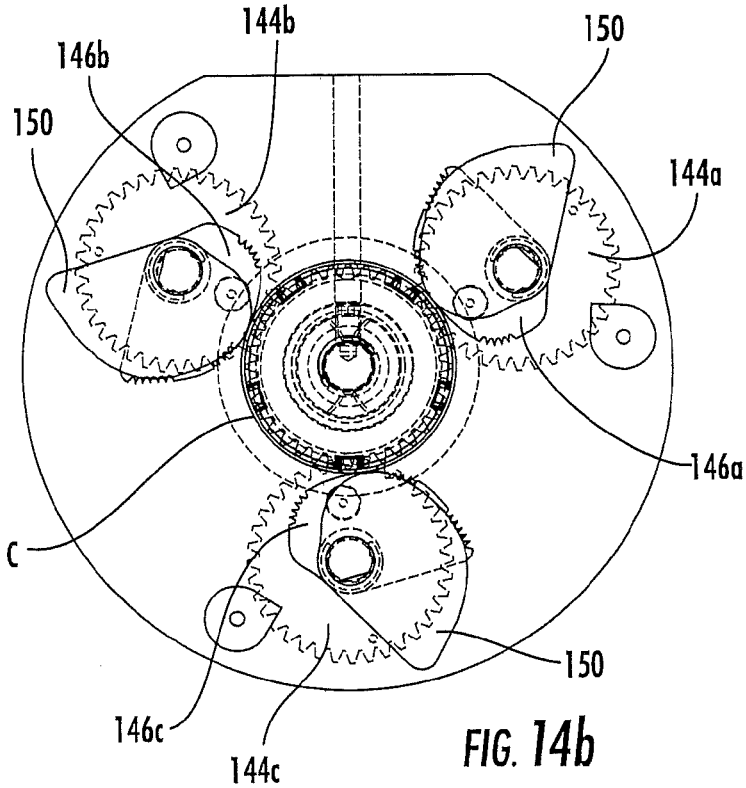
FIG. 14*b* is a top view of the main stage of the closure station of FIG. 6 with the upper stage removed and the sun and clamp gears visible, wherein the clamps are closed on a closure.

Once each shield 150 has contacted the closure C, the shields 150 are forced by the closure C to rotate clockwise relative to their respective clamps 146*a*, 146*b*, 146*c* until the arcuate edges 147*c* of the clamps 146*a*, 146*b*, 146*c* contact and grip the edges of the closure C (see FIG. 14*a*). The rotation of the shields 150 ceases after each of the clamps 146*a*, 146*b*, 146*c* has contacted the closure C; this can be determined based on a predetermined time period, a torque or position sensor, or the like. Through the action of the slip clutch described above with respect to FIGS. 9*a*-9*c* and 12*a*-12*c*, continued rotation of the main stage 138 will not produce additional relative rotation of the main stage 138, the sun gear 140, or the clamps 146*a*, 146*b*, 146*c*. At this point the closure C should be centered in the aperture 154 (FIGS. 14*a* and 14*b*).

Figure 15:
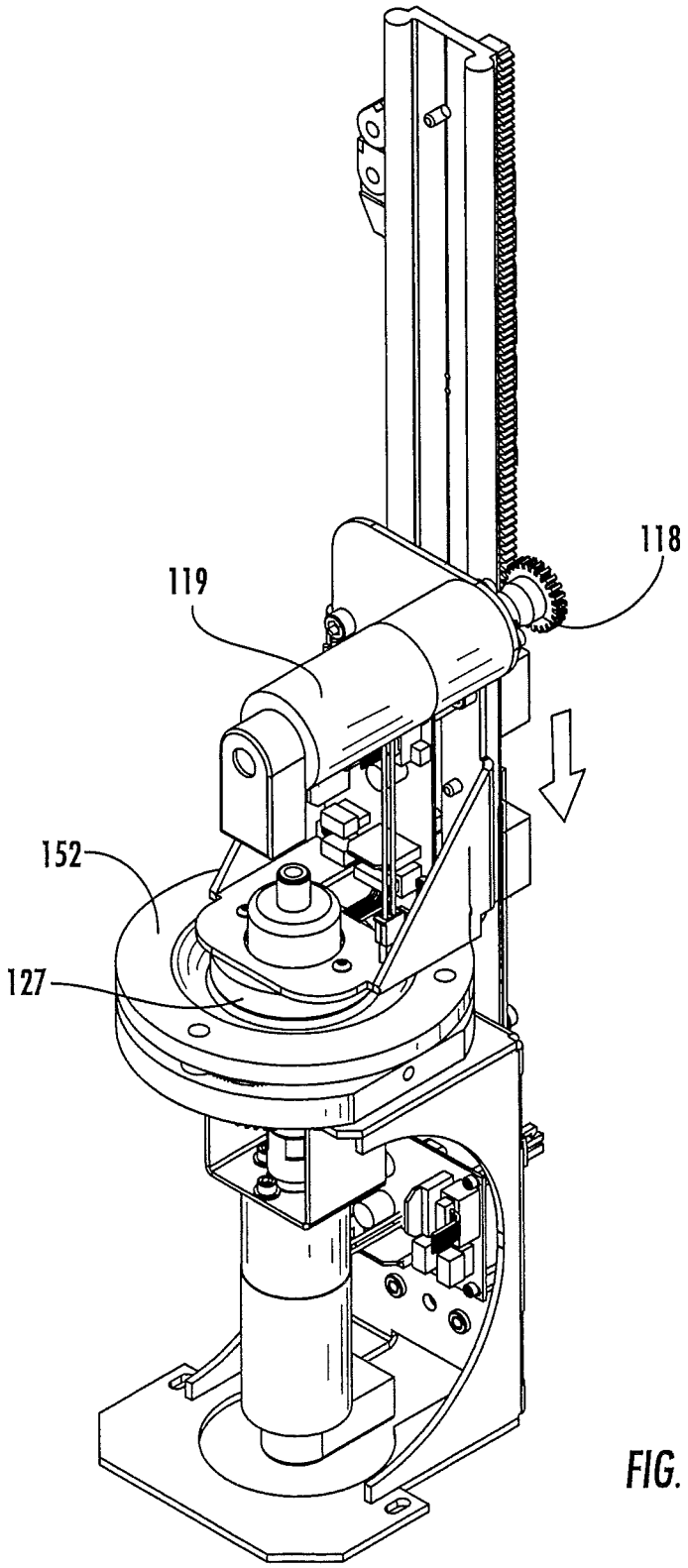
FIG. 15 is a perspective view of the closure station of FIG. 5 showing the elevator capturing the closure.

Once the closure C is centered and rotation of the main stage 138 ceases, the controller 42 actuates the drive motor 119, which rotates the drive gear 118 (the rotation is clockwise from the vantage point of FIGS. 10 and 15). Rotation of the drive gear 118 as its teeth engage the teeth of the rack 120 drives the elevator 110 downward (FIG. 15). The elevator 110 ceases its downward movement when the suction cup 128 positioned beneath suction block 127 contacts the closure C (movement of the elevator 110 ceases responsive to position sensors, force sensors, or the like). At this point the controller 42 signals the suction source to apply suction to the suction cup 128, thereby attaching the closure C thereto.

Figure 16:
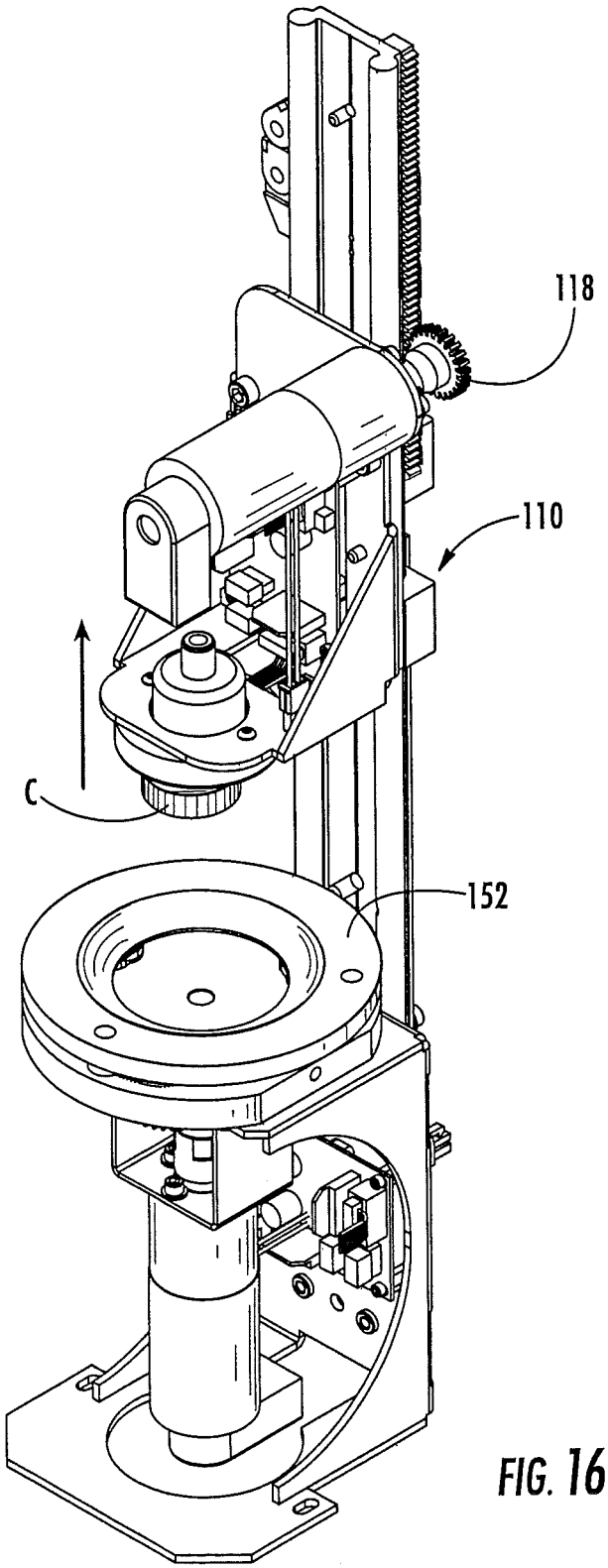
FIG. 16 is a perspective view of the closure station of FIG. 5 showing the elevator and closure in a raised position.

After the closure C is attached to the suction cup 128 (this can be verified with a vacuum contact switch or the like), the controller 42 activates the drive motor 119, which drives the drive gear 118 in a counterclockwise direction and raises the elevator 110, thereby translating the closure C along the axis A2 to a raised position (FIG. 16). In addition, the controller 42 signals the drive motor 134 to reverse direction (i.e., the shaft 136 rotates clockwise from the vantage point of FIGS. 14*a* and 14*b*), which action rotates the clamps 146*a*, 146*b*, 146*c* slightly clockwise toward their original positions to release the substantially centered closure C (FIG. 16).

Figure 17:
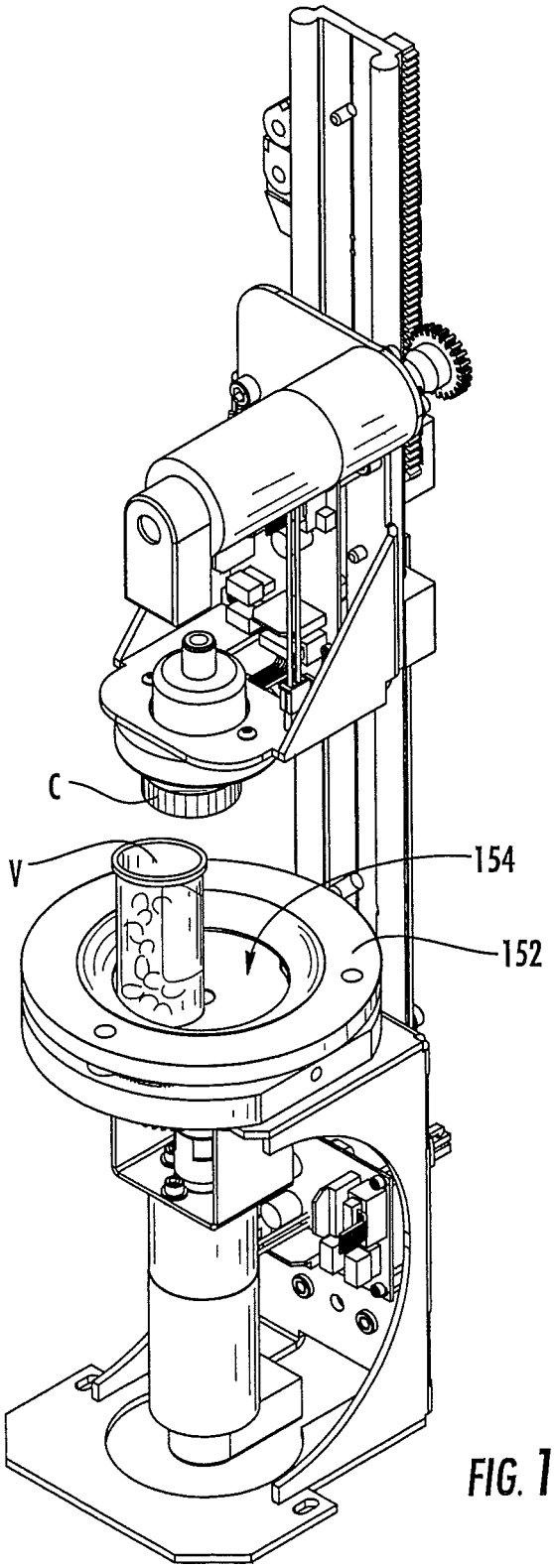
FIG. 17 is a perspective view of the closure station of FIG. 5 showing the receipt of a filled vial on the main stage.
Figure 18:
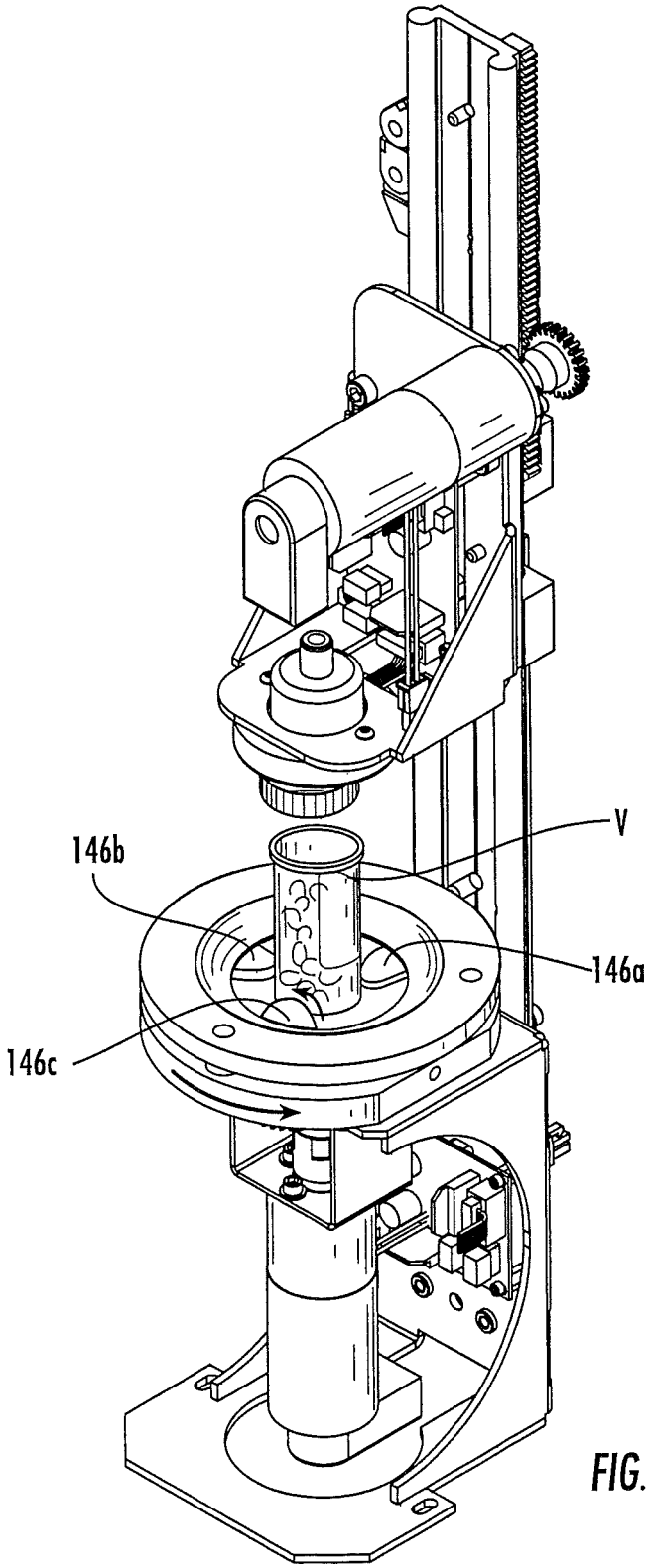
FIG. 18 is a perspective view of the closure station of FIG. 5 showing the operating of the clamps to center the filled vial.

When the elevator 110 has completed its ascension (FIG. 16), having translated the closure C along the axis A2 while maintaining it in a centered condition, the closure station 100 is then free to receive a filled vial V from the dispensing carrier 70 (FIG. 17). The dispensing carrier 70 conveys the filled vial V to the aperture 154 of the upper stage 152, deposits it there, and withdraws. The controller 42 then signals the drive motor 134 to rotate the main stage 138 counterclockwise (from the vantage point of FIG. 12*a*). As described above, this rotation rotates the clamps 146*a*, 146*b*, 146*c* and the shields 150 counterclockwise such that they contact and substantially center the lower end of the filled vial V (FIG. 18). As a result, both the closure C and the filled vial V are substantially centered by the same components. This should register the closure C and the filled vial V along the axis A2 for subsequent securing of the closure C on the filled vial V.

Figure 19:
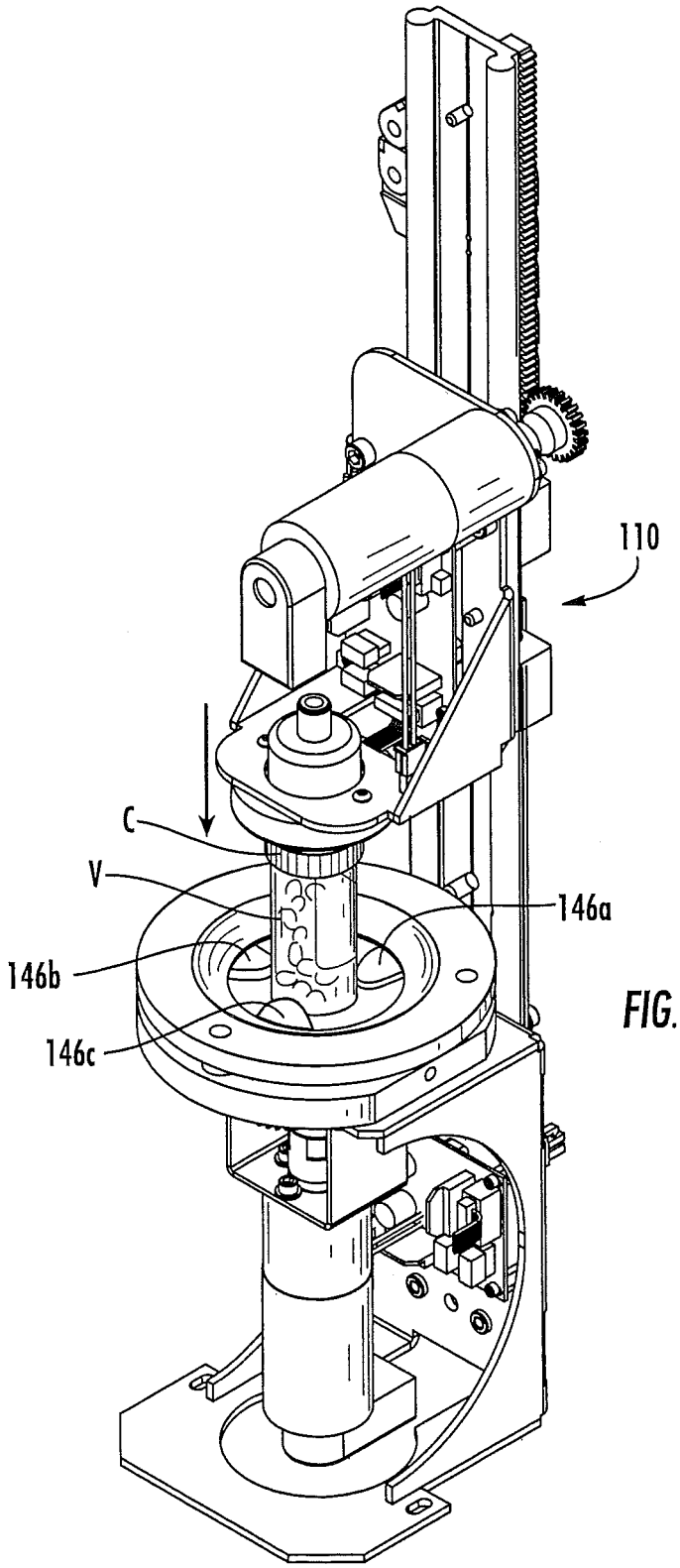
FIG. 19 is a perspective view of the closure station of FIG. 5 showing the lowering of the elevator to deposit the closure on the filled vial.

At the same time, the controller 42 activates the drive motor 119 to lower the elevator 110 and translate the closure C along the axis A2 until the closure C is in position just above the top of the filled vial V (FIG. 19). The main stage 138 continues to rotate, and the elevator 110 descends until the closure C encloses the perimeter of the upper edge of the filled vial V (movement of the elevator 110 continues responsive to position sensors, force sensors, or a combination thereof). The elevator 110 maintains a downwardly-directed force to urge the closure C against the upper edge of the vial V.

Figure 20:
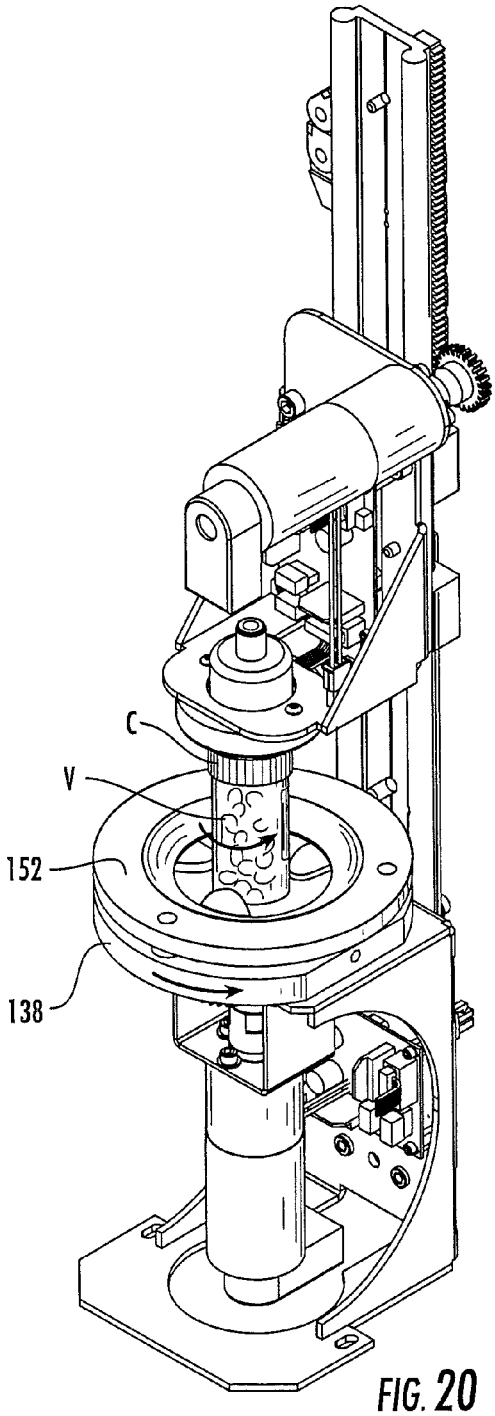
FIG. 20 is a perspective view of the closure station of FIG. 5 showing the rotation of the main stage to secure the closure to the filled vial.
Figure 20A:
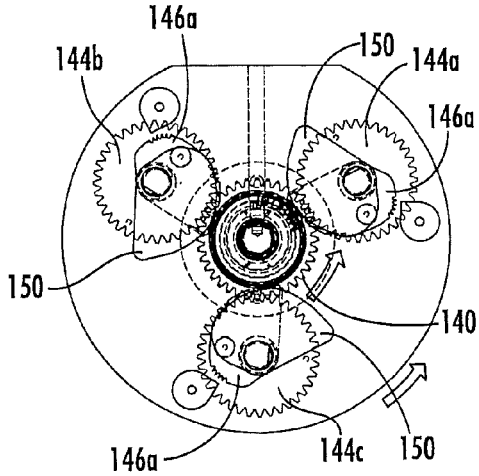
FIG. 20*a* is a top view of the main stage of the closure station of FIG. 6 with the upper stage removed showing the sun gear rotating with the main stage.

Once the closure C is in position for securing, the main stage 138 continues its counterclockwise rotation (with the closure C remaining stationary due to friction between it and the suction cup 128). Because the clamps 146*a*, 146*b*, 146*c* are clamped against the vial V, they are prevented from further counterclockwise rotation. Accordingly, the clamp gears 144*a*, 144*b*, 144*c* are also prevented from rotating counterclockwise. As a result, the clamp gears 144*a*, 144*b*, 144*c* apply a counterclockwise torque to the sun gear 140 (see FIGS. 20, 20*a* and 20*b*). This torque overcomes the friction between the sun gear 140 and the clutch washer 141, thereby enabling the sun gear 140 to rotate counterclockwise with the shaft 136 and the main stage 138 (and the vial V clamped thereon) to continue to rotate counterclockwise. This counterclockwise rotation of the vial V relative to the stationary closure C twists the closure C onto the vial V (see FIG. 20). Rotation can be halted based on a predetermined time period, a position sensor, a torque sensor, or the like.

Figure 20B:
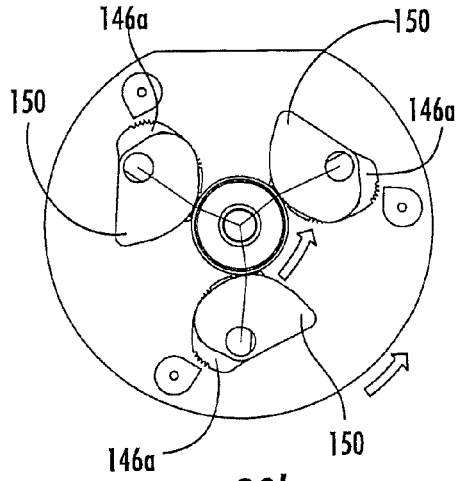
FIG. 20*b* is a top view showing the positions of the clamps and shields as the sun gear rotates with the main stage while securing a vial with a closure.
Figure 21:
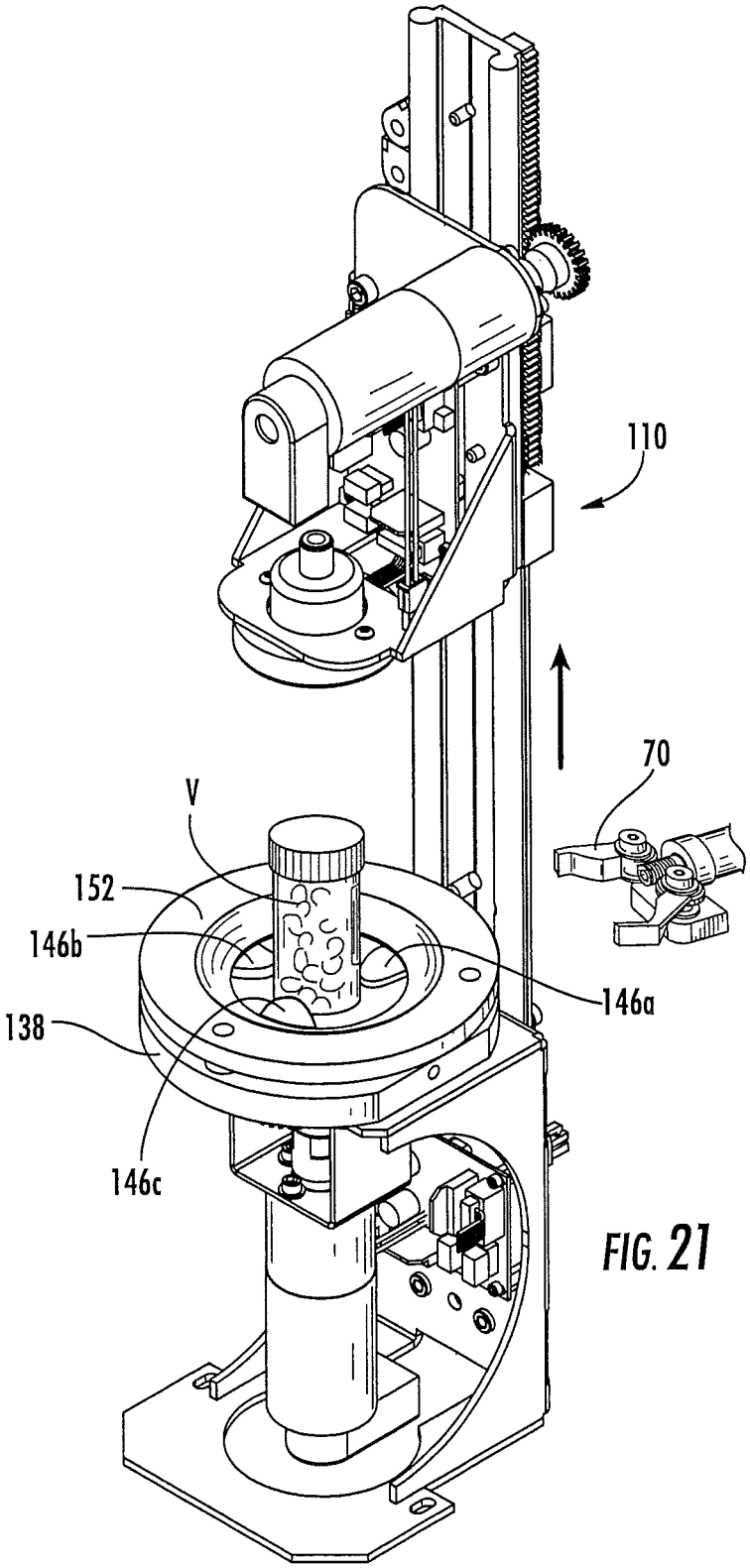
FIG. 21 is a perspective view of the closure station of FIG. 5 showing the elevator in the raised position and the dispensing carrier retrieving the filled, capped vial from the closure station.

It is also notable that, in the illustrated embodiment, the positions of the teeth 148*a*, 148*b*, 148*c* on the arcuate edge 147*c* of each clamp 146*a*, 146*b*, 146*c* are selected such that, as the closure C is centered, the angle between the respective axis A3, A4, A5 of each clamp 146*a*, 146*b*, 146*c*, the point of contact of the teeth 148*a*, 148*b*, 148*c* with the vial V, and the axis A2 approaches, but does not exceed, 180 degrees (an angle of between about 140 and 178 degrees is typical—see FIG. 20*b*). This angular relationship can provide a high gripping force for the clamps 146*a*, 146*b*, 146*c* on the vial V and can generate a high reactive torque in the clamping gears 144*a*, 144*b*, 144*c* to assist the sun gear 140 in overcoming the friction provided by the clutch washer 141. In the illustrated embodiment, the positions of the teeth 148*a*, 148*b*, 148*c* are selected to correspond to three popular vial sizes, but other embodiments may employ teeth in different locations, may omit them entirely, may have a different number of sets of teeth, or may have virtually the entire arcuate edge 147*c* covered with a continuous set of teeth.

Once securing of the closure C is complete, the controller 42 signals the suction source to deactivate, activates the drive motor 119 to raise the elevator 110, and activates the drive motor 134 to rotate the main stage clockwise to release the clamps 146*a*, 146*b*, 146*c* from the now-capped filled vial V. The controller 42 then signals the dispensing carrier 70 (FIG. 21) to retrieve the capped, filled vial V for subsequent operations (such as offloading). The clamps 146*a*, 146*b*, 146*c* rotate clockwise until their straight edges 147*a* contact the stops 151, which action slides the shields 150 back to their original positions atop their respective clamps.

Those skilled in this art will recognize that other configurations of the closure station 100 may also be employed with the present invention. For example, delivery of the closure C to the closure station 100 may be carried out with any number of techniques, including through the use of chutes, channels, belts or other conveying devices of different configurations, robotic or "pick and place" delivery, or other methods known to those skilled in this art.

Figure 10A:
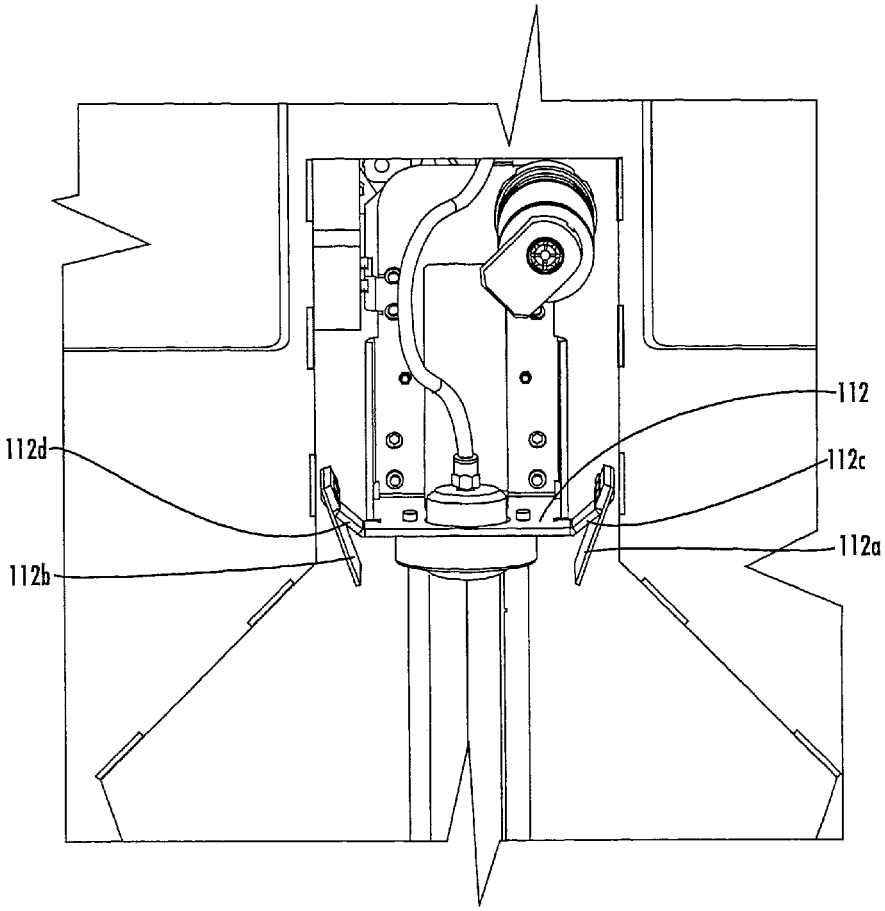
FIG. 10*a* is a front view of a closure station with wings according to alternative embodiments of the invention.
Figure 11:
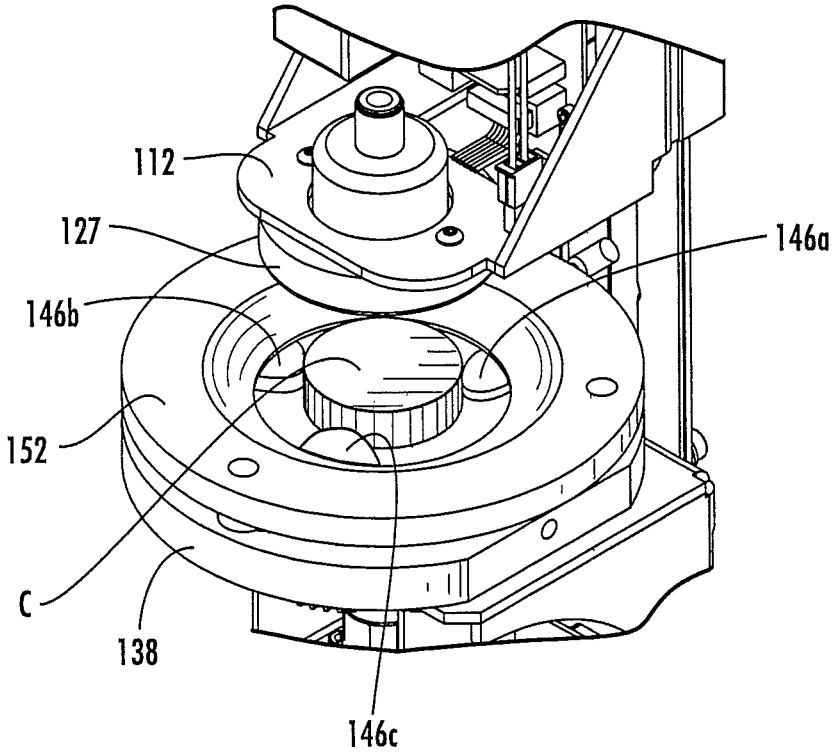
FIG. 11 is an enlarged perspective view of the closure station of FIG. 5 showing the clamping of a closure.
Figure 12A:
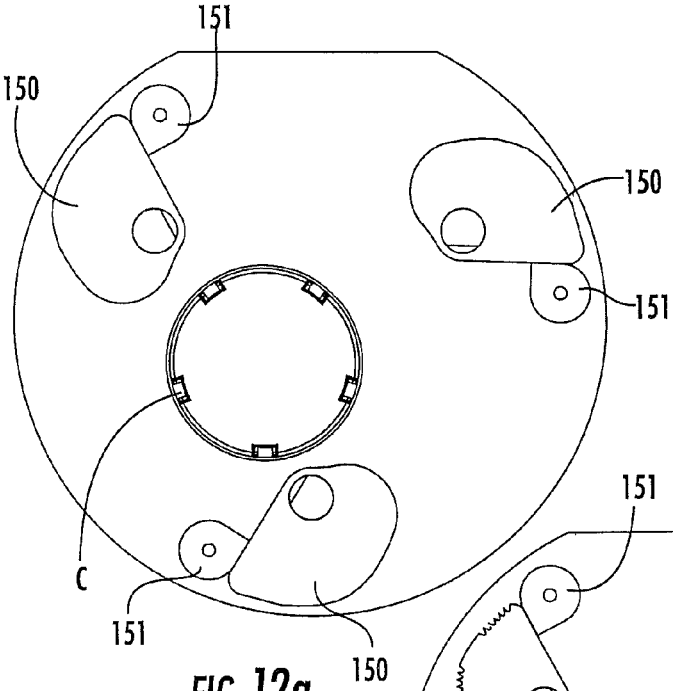
FIG. 12*a* is a top view of the main stage of the closure station of FIG. 6 with the upper stage removed and the clamps and shields retracted.
Figure 12B:
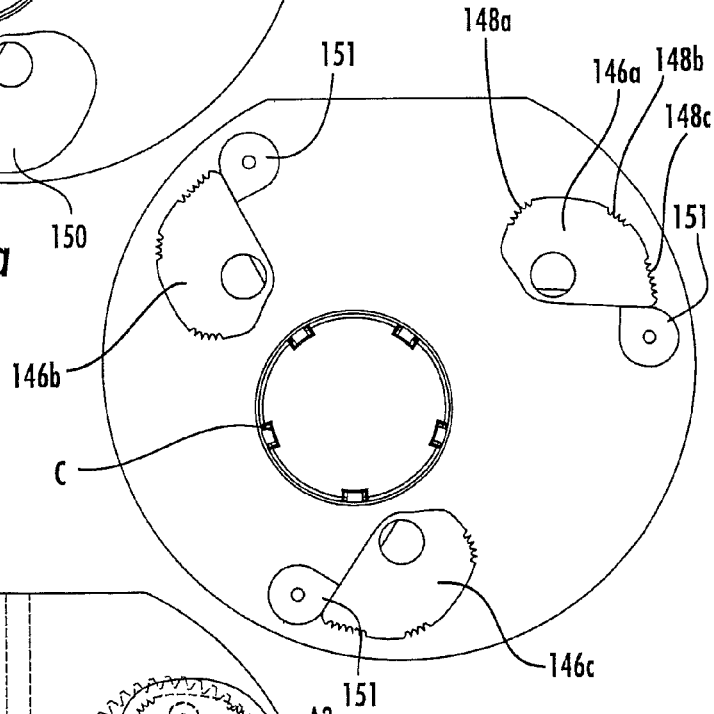
FIG. 12*b* is a top view of the main stage of the closure station of FIG. 6 with the upper stage and shields removed and the clamps retracted.
Figure 12C:
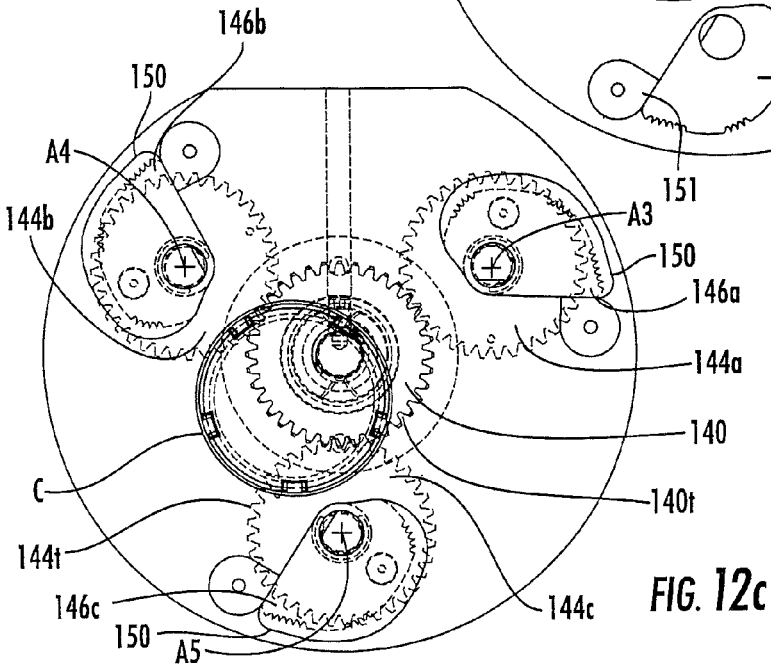
FIG. 12*c* is a top view of the main stage of the closure station of FIG. 6 with the upper stage removed and the sun and clamp gears visible, wherein the clamps are retracted.
Figure 13A:
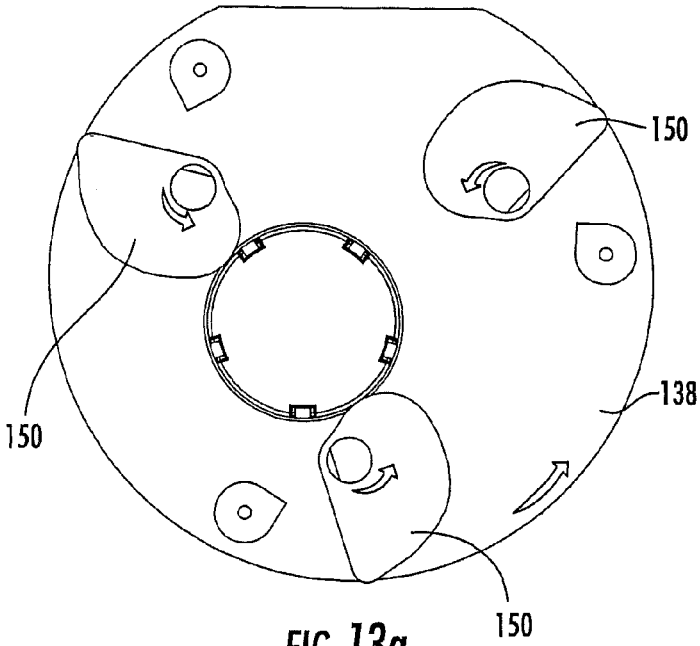
FIG. 13*a* is a top view of the main stage of the closure station of FIG. 6 with the upper stage removed showing the clamps and shields closing on a closure.
Figure 13B:
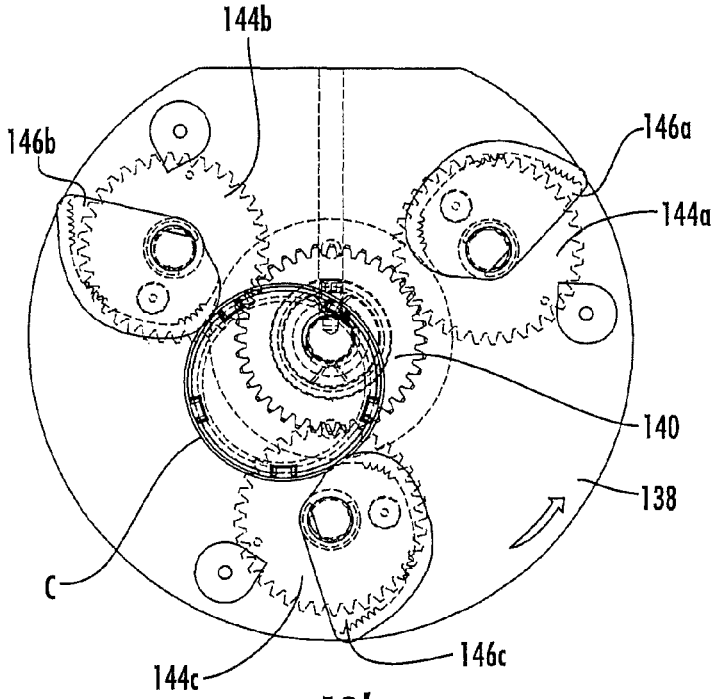
FIG. 13*b* is a top view of the main stage of the closure station of FIG. 6 with the upper stage removed and the sun and clamp gears visible, wherein the clamps and shields are closing on a closure.

As another example, in some embodiments, and as shown in FIG. 10*a*, the floor 112 may include wings 112*a*, 112*b* on either side thereof. The wings 112*a*, 112*b* are mounted on upwardly-turned flanges 112*c*, 112*d*. The wings 112*a*, 112*b* are formed of flexible sheets of polymeric material. In this embodiment, when the closure C is released from a chute (not shown), the gap between the suction pad 128 and the upper stage 152 is such that the wings 112*a*, 112*b* are positioned in the chutes and are deflected slightly. The wings 112*a*, 112*b* can act as gates that stop the movement of the closure C in the chute. Subsequent elevation of the elevator 110 raises the wings 112*a*, 112*b* out of the chutes so that the closure C can continue to the main stage 138. Inclusion of the wings 112*a*, 112*b* can prevent the closure C from "overshooting" the main stage 138 as it descends in the chute and can also help to control the final position of the closure C on the main stage by controlling the speed of the closure C.

In other embodiments, the centering assembly 130 may have a different configuration. For example, the sun gear 140 may be omitted, and a drive motor or similar drive unit may be attached to the central shaft 136 that depends from the main stage, such that the main stage 138 is driven directly by the shaft 136. The shields 150 may be omitted in some embodiments, or friction between the shields 150 and the clamps 146*a*, 146*b*, 146*c* may be created via a clutch or similar mechanism. Also, in certain embodiments, the upper stage 152 may be omitted, and the main stage 138 may have a concave upper surface, such that a closure entering the closure station is centered generally by the contour of the upper surface of the main stage prior to clamping with the clamps 146*a*, 146*b*, 146*c*. Alternatively, the main stage 138 may be stationary (as would the vial captured thereby) as a component of the elevator rotates a closure held by the elevator. As another alternative, the capped vial may arrive unlabeled for capping and the label may be applied as the vial rotates during or after capping.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An apparatus for centering and gripping an object, comprising:

a main stage notable via a drive unit about a first axis of rotation;

a plurality of centering members pivotally interconnected with the main stage, each of the centering members being rotatable about a respective axis of rotation, the axes of rotation being substantially parallel with each other, wherein rotation of the centering members about their respective axes of rotation causes the centering members to contact an object positioned on the main stage, and wherein contact with each of the centering members indicates that the object is centered on the stage;

wherein the centering assembly includes a central sun gear that rotates with the main stage about the first axis, and wherein each of the centering members is connected to and rotatable with a respective centering member gear, each of the centering member gears engaging and being driven by the sun gear; and wherein the sun gear is coupled to a drive unit via a clutch; and wherein the clutch is configured such that, when the centering members are free to rotate relative to the main stage, the clutch engages the sun gear, such that the sun gear remains stationary and the centering member gears rotate relative to the main stage, and wherein when the centering members are prevented from rotating, the sun gear rotates with the main stage.

2. The apparatus defined in claim 1, wherein each of the centering members includes an arcuate contact edge.

3. The apparatus defined in claim 2, wherein the arcuate contact edge includes multiple sets of gripping teeth.

4. The apparatus defined in claim 1, wherein the centering assembly includes an upper stage positioned above the main stage, the upper stage including an aperture sized to receive a closure and a container.

5. The apparatus defined in claim 4, wherein the upper stage has sloping surfaces that drain into the aperture of the upper stage.

6. The apparatus defined in claim 2, wherein a shield resides above each centering member and rotates about its respective centering member axis, an edge of the shield overlapping the arcuate edge of the centering member.

7. The apparatus defined in claim 6, wherein each of the shields is magnetically attracted to its respective centering member, such that the shield rotates with the centering member until the shield edge strikes an object and experiences a force above a predetermined magnitude, at which point the shield counter-rotates relative to the centering member.

8. The apparatus defined in claim 1, wherein the clutch includes a clutch washer in contact with the sun gear, the clutch washer being configured to create friction force with the sun gear sufficient to prevent the sun gear from rotating with the main stage when the centering members are free to rotate, but insufficient to prevent the sun gear from rotating with the main stage when the centering members are prevented from rotating.

9. The apparatus defined in claim 8, wherein the clutch further includes a spring that forces the sun gear into the clutch washer.

10. The apparatus defined in claim 9, wherein the drive unit includes a shaft that is fixed to the main stage, the shaft having a shoulder in contact with the spring, and wherein the clutch includes a first thrust bearing in contact with the spring, a bearing that is prevented from rotating relative to the main stage, the bearing in contact with the first thrust bearing and the clutch washer, and a second thrust bearing in contact with the sun gear and the main stage.

* * * * *

UNITED STATES PATENT AND TRADEMARK OFFICE

CERTIFICATE OF CORRECTION

PATENT NO. : 8,444,130 B2
APPLICATION NO. : 12/732462
DATED : May 21, 2013
INVENTOR(S) : Sink et al.

It is certified that error appears in the above-identified patent and that said Letters Patent is hereby corrected as shown below:

On Title Page:
Item 75, Inventors: Please correct "Richard D. Mitchelli, Raleigh, NC (US);"
to read -- Richard D. Michelli, Raleigh, NC (US); --

In the Claims:
Column 11, Claim 1, Line 38:
Please correct "stage notable via a drive"
to read -- stage rotatable via a drive --

Signed and Sealed this
Twenty-fifth Day of February, 2014

Michelle K. Lee

Michelle K. Lee
*Deputy Director of the United States Patent and Trademark Office*